US010174533B2

(12) United States Patent
Crolley

(10) Patent No.: US 10,174,533 B2
(45) Date of Patent: Jan. 8, 2019

(54) HINGE

(71) Applicant: AT&T Intellectual Property I, L.P., Atlanta, GA (US)

(72) Inventor: Wayne Crolley, Bryant, AR (US)

(73) Assignee: AT&T INTELLECTUAL PROPERTY I, L.P., Atlanta, GA (US)

( * ) Notice: Subject to any disclaimer, the term of this patent is extended or adjusted under 35 U.S.C. 154(b) by 182 days.

(21) Appl. No.: 15/065,905

(22) Filed: Mar. 10, 2016

(65) Prior Publication Data

US 2017/0260783 A1 Sep. 14, 2017

(51) Int. Cl.

| | |
|---|---|
| ***E05D 3/02*** | (2006.01) |
| ***E05F 3/20*** | (2006.01) |
| ***E05D 11/00*** | (2006.01) |

(52) U.S. Cl.

CPC ..... *E05D 3/02* (2013.01); *E05D 11/00* (2013.01); *E05F 3/20* (2013.01); *E05Y 2201/21* (2013.01); *E05Y 2900/132* (2013.01); *Y10T 16/546* (2015.01)

(58) Field of Classification Search

CPC ..... E05D 3/02; E05D 11/00; E05D 11/0081; E05F 3/20; E05Y 2201/21; E05Y 2900/132; H01H 3/162; Y10T 16/546; Y10T 16/558; Y10T 16/304; Y10T 16/283; Y10T 16/62

USPC ..... 16/365, 387, 50, 68, 84; 439/31, 165; 340/545.1, 545.7; 200/61.7

See application file for complete search history.

(56) References Cited

U.S. PATENT DOCUMENTS

| | | | | |
|---|---|---|---|---|
| 1,029,281 | A | 6/1912 | Davis | |
| 1,727,321 | A * | 9/1929 | Arocha | E05D 3/02 16/365 |
| 3,772,669 | A | 11/1973 | Johnston et al. | |
| 3,842,386 | A * | 10/1974 | Suska | E05D 11/0081 174/86 |
| 4,049,934 | A | 9/1977 | Newlon | |
| 4,066,857 | A | 1/1978 | Suska | |
| 4,140,357 | A | 2/1979 | Wolz et al. | |
| 4,148,001 | A | 4/1979 | Gwozdz | |
| 4,168,409 | A | 9/1979 | McNinch | |
| 4,211,990 | A | 7/1980 | Gwozdz | |
| 4,841,283 | A | 6/1989 | Bubliewicz | |
| 4,922,064 | A | 5/1990 | Price et al. | |
| 5,701,636 | A * | 12/1997 | Jahnke | E05D 7/0423 16/237 |
| 5,717,380 | A | 2/1998 | Zehrung | |
| 6,577,235 | B2 | 6/2003 | Frys | |
| 6,724,285 | B1 | 4/2004 | Zehrung | |
| 7,522,042 | B2 | 4/2009 | Milo | |

(Continued)

OTHER PUBLICATIONS

Unknown, NYCE Door Hinge Sensor, http://nycesensors.com/wp-content/uploads/2015/07/NCZ-3010-Door-Hinge-Sensor-Feature-Sheet-2015-07-14.pdf, 1 page.

*Primary Examiner* — William L Miller

(74) *Attorney, Agent, or Firm* — Scott P. Zimmerman, PLLC

(57) ABSTRACT

An intelligent hinge determines motions of a swinging door. The hinge has an accelerometer secured to a leaf of the hinge. As the door swings, the leaf also rotates and the accelerometer determines an acceleration value. A velocity of the swinging door may be determined from the acceleration value. An initial, instantaneous, and final angular position of the door may also be determined from the acceleration value.

20 Claims, 28 Drawing Sheets

(56) References Cited

U.S. PATENT DOCUMENTS

| | | | | |
|---|---|---|---|---|
| 7,610,684 | B2 | 11/2009 | Steinich | |
| 8,225,458 | B1 * | 7/2012 | Hoffberg | E05F 3/102 16/49 |
| 8,928,477 | B2 | 1/2015 | Herglotz et al. | |
| 9,214,274 | B2 | 12/2015 | Herglotz et al. | |
| 9,697,718 | B1 * | 7/2017 | O'Larte | G08B 21/182 |
| 2003/0221286 | A1 * | 12/2003 | Pinto | E05D 5/04 16/321 |
| 2010/0194563 | A1 * | 8/2010 | Berner | E05D 11/00 340/545.1 |
| 2013/0000203 | A1 * | 1/2013 | Platt | E05D 3/08 49/246 |
| 2015/0022027 | A1 | 1/2015 | Pizzato et al. | |
| 2015/0029033 | A1 | 1/2015 | Pizzato et al. | |
| 2015/0366113 | A1 * | 12/2015 | Sreetharan | E05D 1/00 16/225 |
| 2017/0186303 | A1 * | 6/2017 | O'Larte | G08B 21/182 |
| 2017/0213440 | A1 * | 7/2017 | O'Larte | G08B 21/182 |
| 2017/0306674 | A1 * | 10/2017 | Soloski | E05D 11/0081 |

* cited by examiner

HINGE

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND

Hinges are common in homes and businesses. Conventional hinges allow a door or window to swing open and closed.

BRIEF DESCRIPTION OF THE SEVERAL VIEWS OF THE DRAWINGS

The features, aspects, and advantages of the exemplary embodiments are understood when the following Detailed Description is read with reference to the accompanying drawings, wherein.

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
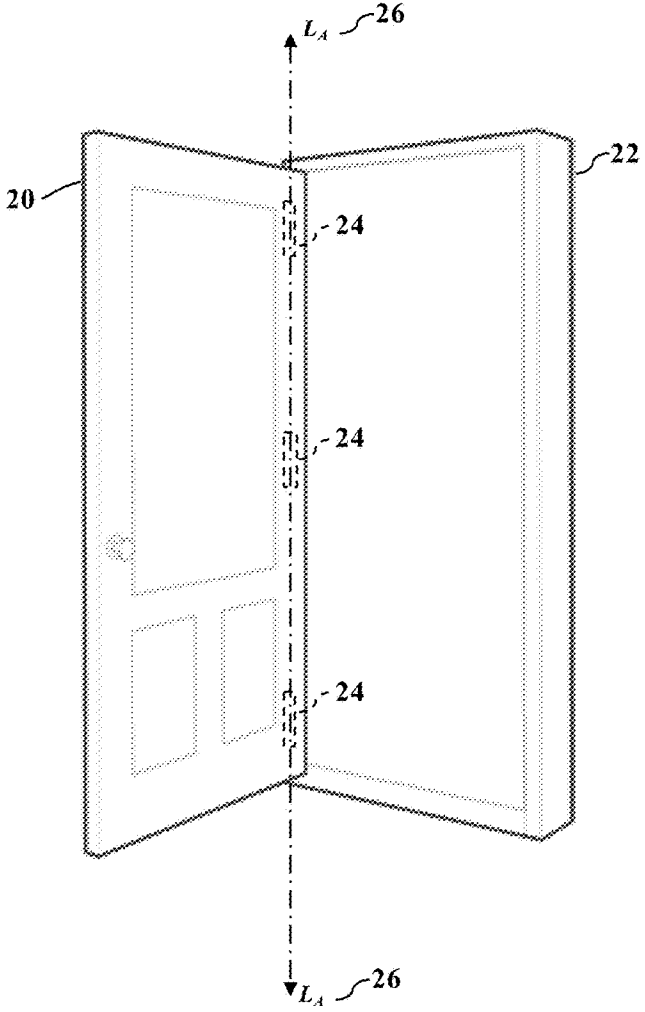
FIGS. 1-9 are simplified illustrations of an environment in which exemplary embodiments may be implemented.

FIGS. 1-9 are simplified illustrations of an environment in which exemplary embodiments may be implemented. FIG. 1 illustrates a door 20 hinged about a door frame 22. As the reader likely understands, the door 20 is mounted or secured to the door frame 22 using one or more hinges 24. The hinges 24 allow the door 20 to pivot about an axis $L_A$-$L_A$ (illustrated as reference numeral 26). A human user may thus swing the door 20 between an open position and a closed position, as the reader understands.

Figure 2:
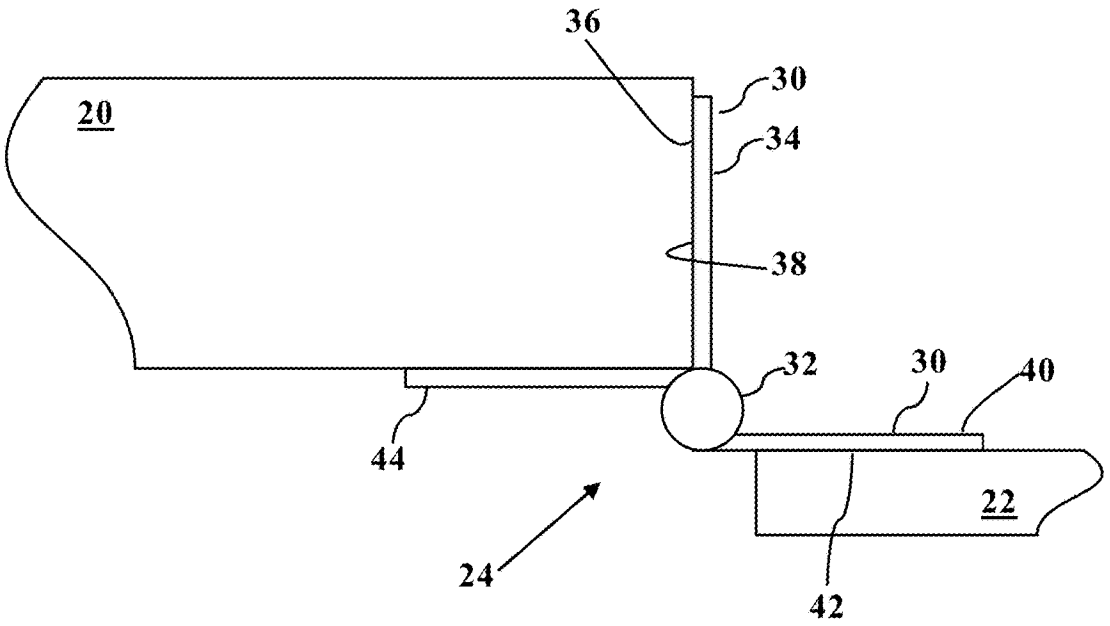
Figure 3:
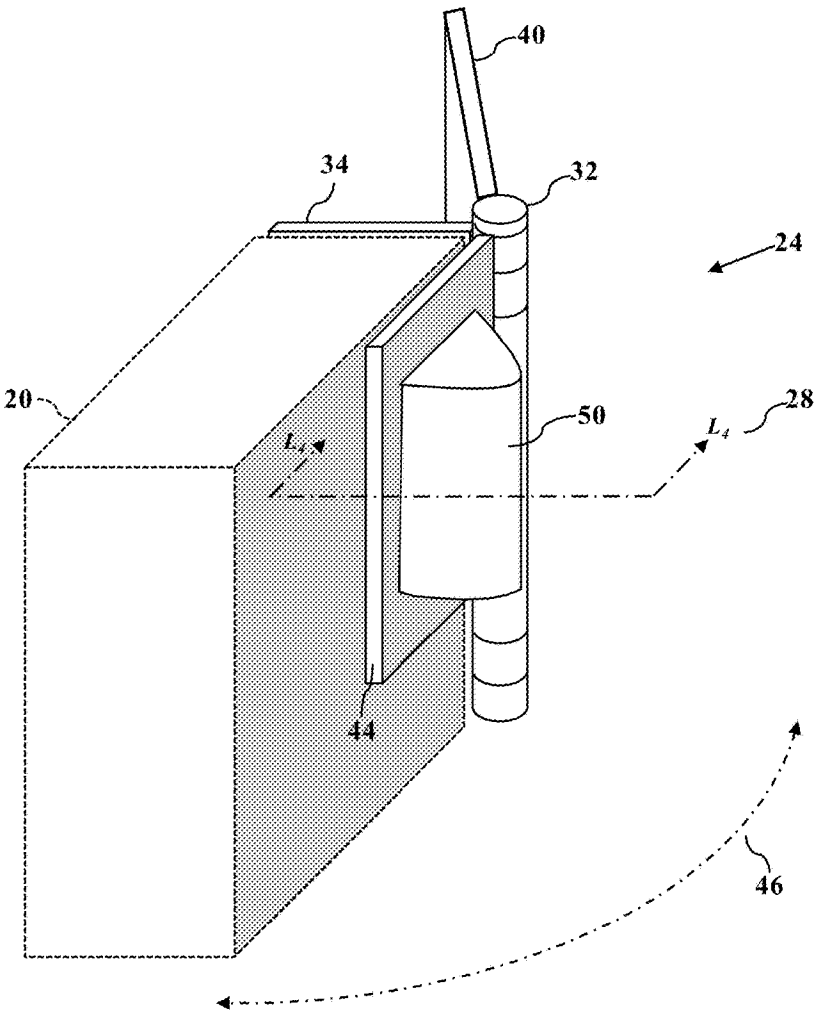
Figure 4:
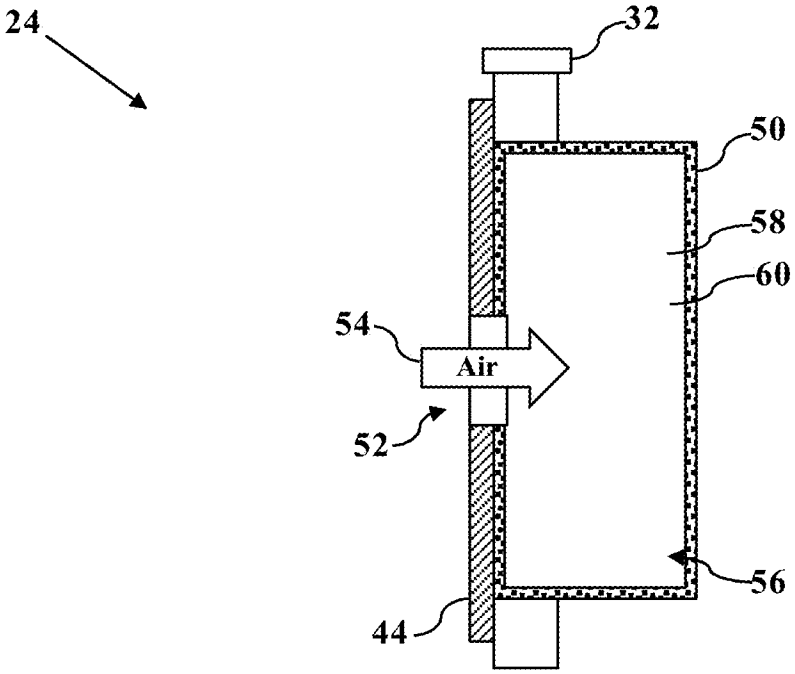

FIGS. 2-4 illustrate more details of the hinge 24. FIG. 2 is a top view of the hinge 24 secured to the door 20. FIG. 3 is an isometric view of the hinge 24, while FIG. 4 is a sectional view of the hinge 24 taken along line $L_4$-$L_4$ (illustrated as reference numeral 28). The reader may recognize a pair 30 of leaves that rotate about a pin 32. A first leaf 34, for example, mounts to an edge 36 or jamb 38 of the door 20, and a second leaf 40 mounts to the door frame 22 (such as a wall jamb 42). The door 20 may thus articulate about the pin 32, as the reader understands.

Here, though, the hinge 24 may also include velocity control. The hinge 24 may include a third leaf 44 that also rotates about the pin 32. As the door 20 swings during closing and opening, the third leaf 44 may include a means for damping a velocity of rotation (illustrated as reference numeral 46). Exemplary embodiments, for example, may include a hollow casing 50. As FIG. 4 best illustrates, the third leaf 44 may include a one-way vent 52 in fluid/air communication with the hollow casing 50. FIG. 2 illustrates the vent 52 as an opening or a passage in the third leaf 44, but the vent 52 may have other configurations and locations (as later paragraphs will explain). Regardless, as the door 20 swings, the third leaf 44 rotates about the pin 32, and a volume 54 of air attempts to flow or pass through the vent 52 and into an interior 56 of the hollow casing 50. The vent 52, though, may only flow in a single direction into the interior 56 of the hollow casing 50. The volume 54 of air may thus not exit. The hollow casing 50 is thus preferably substantially air-tight, thus acting as a pneumatic air chamber 58. The hollow casing 50, in other words, acts as a physical or flow/pressure restriction to the volume 54 of air flowing through the vent 52. Exemplary embodiments thus cushion or damp the motion of the door 20, akin to a parachute. Indeed, if the hollow casing 50 is constructed to have little or negligible deformation and/or expansion, an internal pressure 60 in the chamber 58 may not significantly exceed atmospheric pressure. So, as the door 20 swings, exemplary embodiments may limit the volume 54 of air passing through the vent 52 and into the hollow chamber 58, thus slowing or damping the velocity 46 of rotation of the door 20.

Figure 5:
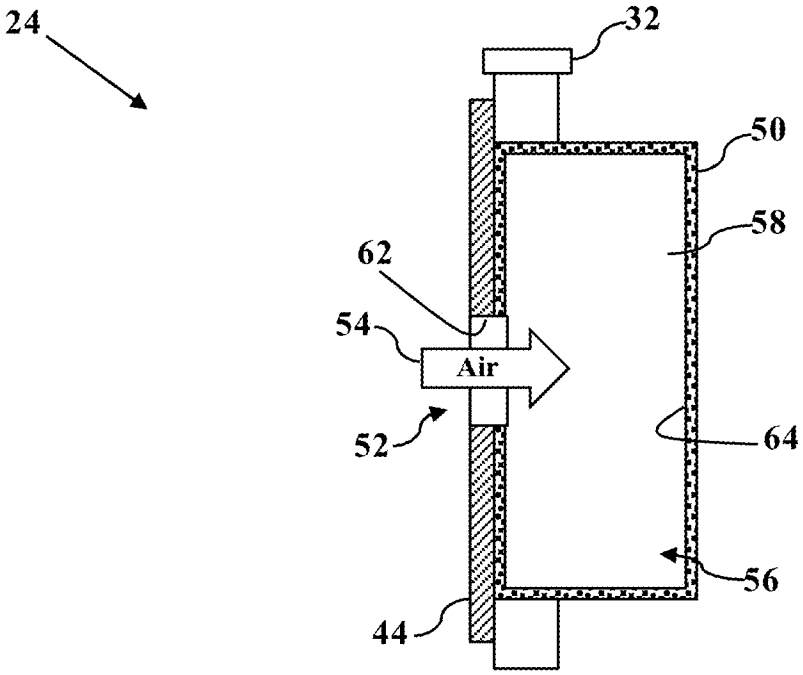

FIG. 5 illustrates tunable design parameters. Some homeowners may want a quicker or faster door swing, depending on occupant needs or physical situations. Businesses, likewise, may want to adjust door speed based on many factors, such as a count or flow of passing customers. Exemplary embodiments may thus adjust a cross-sectional area 62 of the vent 52, and/or an interior volume 64 of the chamber 58, to control the velocity 46 of the door 20. The vent 52 and the chamber 58 may thus be sized, shaped, and tuned to limit the volume 54 of air passing through the vent 52 and thus control the motion of the door 20.

Figure 6:
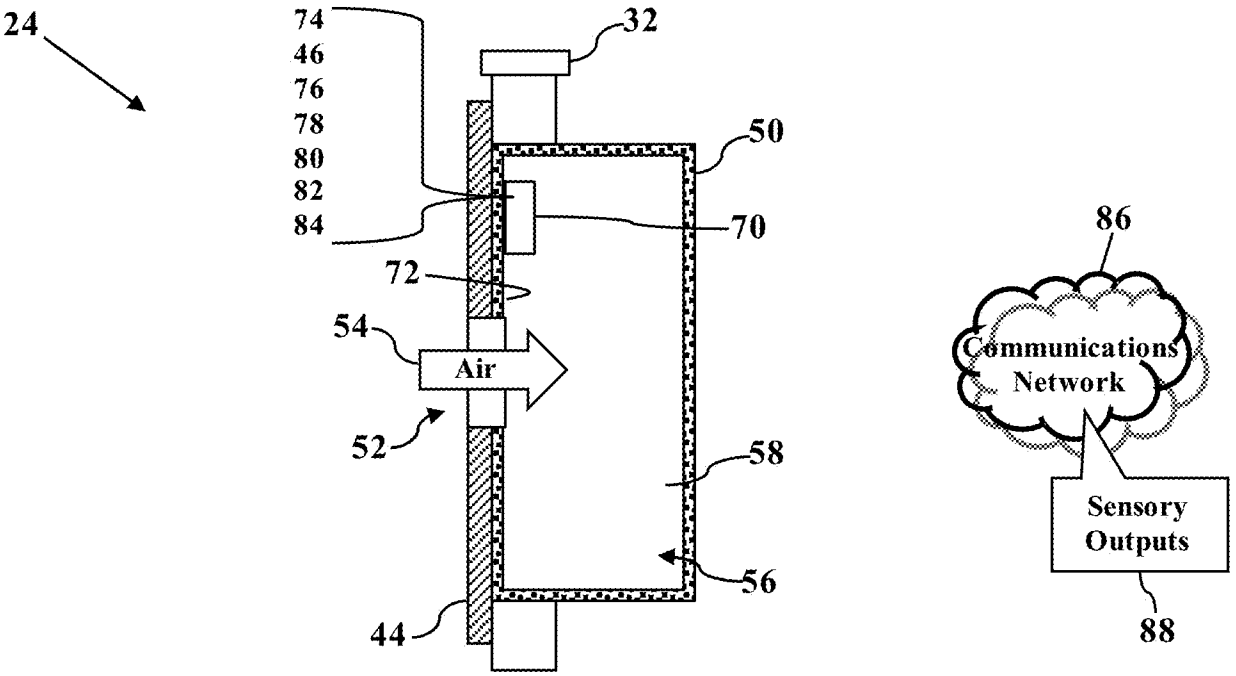

FIG. 6 is another sectional view that illustrates sensory capabilities. The sectional view is again taken along line $L_4$-$L_4$ (illustrated as reference numeral 28) in FIG. 3. Here the hinge 24 may include electronic componentry 70 that provides intelligent functionality. FIG. 6, for simplicity, illustrates the electronic componentry 70 as a package or chip mounted or glued to an interior surface 72 of the hollow chamber 58. As the third leaf 44 pivots about the pin 32, the electronic componentry 70 may measure or infer information or data that describes the pivoting third leaf 44 and, thus, the moving door 20. For example, the electronic componentry 70 may include a speed sensor 74 that detects, determines, or infers the velocity 46 associated with the swinging door 20. The electronic componentry 70 may also include a position sensor 76 that detects, determines, or infers an angular position 78 associated with the door 20. The electronic componentry 70 may further include a processor 80, a memory device 82, and a network interface 84 to a communications network 86. The electronic componentry 70 may thus wirelessly send sensory outputs 88 to some network destination address.

Figure 7:
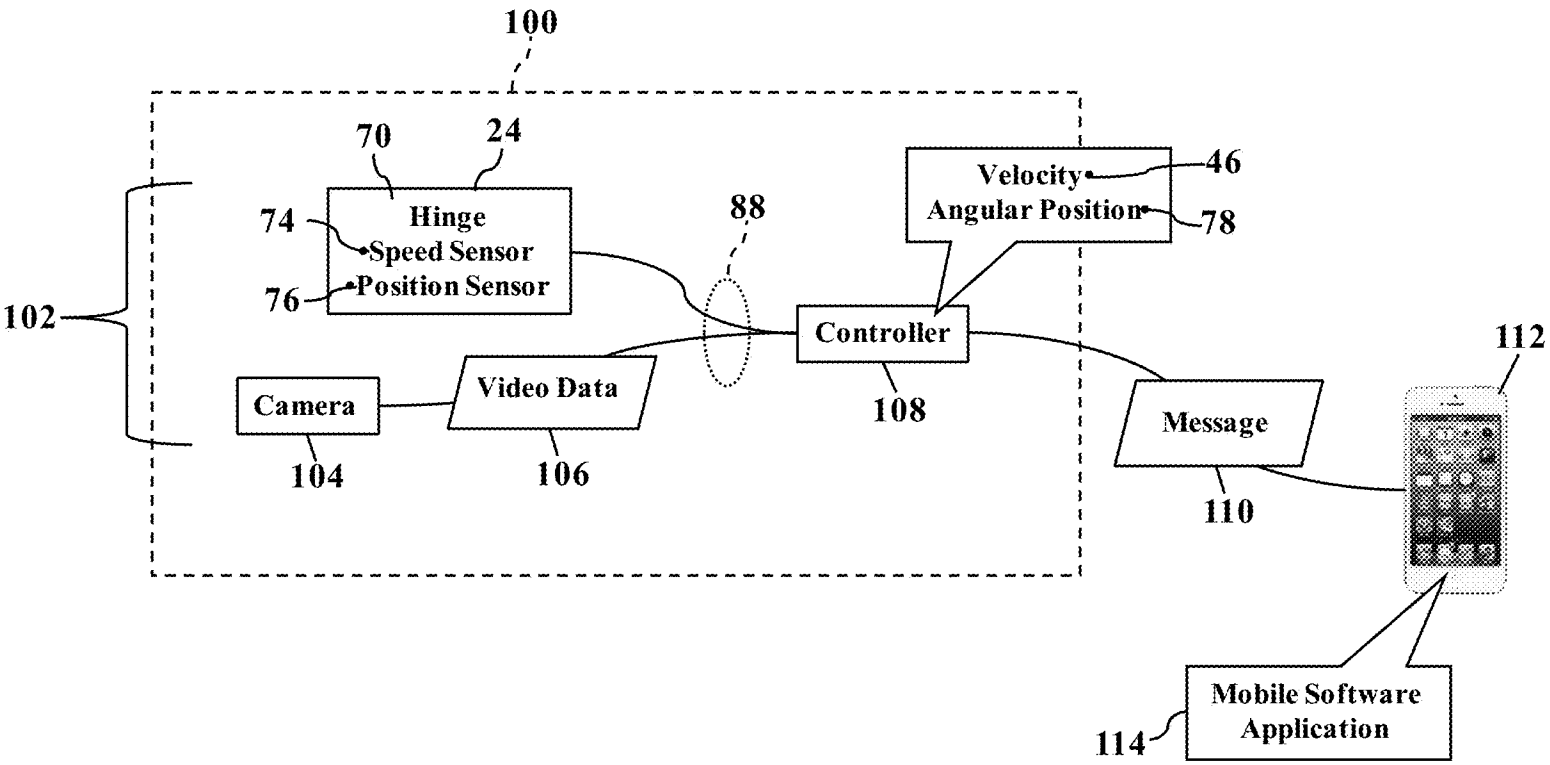

FIG. 7 illustrates a security system 100. Here the electronic componentry 70 of the hinge 24 may interface with the security system 100 to provide security services. As most readers likely understand, the security system 100 may have many sensors 102 that protect occupants from fire, intrusion, and other security conditions. A wireless or wired camera 104, for example, captures video data 106 of some area inside or outside the home or business. Other sensors 102 (such as motion detectors, carbon monoxide and fire sensors, water sensors, and any other sensory devices) may also monitor areas and generate their respective sensory outputs 88. Whatever the sensor 102, the sensory output(s) 88 may be sent to a security controller 108. The security controller 108 may use or evaluate the sensory output(s) 88 and determine a health or safety concern that requires emergency reporting (such as a fire, intrusion, or other alarm event). The security controller 108 may thus generate an alarm message 110 that summons emergency personnel (such as a central monitoring station, as is known). The security controller 108 may also have remote reporting and management capabilities, such as interfacing with a user's smartphone 112 or other mobile device. Exemplary embodiments may thus interface with a mobile software application 114 to remotely report movements of the door 20, as detected by the hinge 24.

Here, then, the electronic componentry 70 in the hinge 24 may also interface with the security controller 108. For example, the electronic componentry 70 may wirelessly send its sensory outputs 88 generated by the speed sensor 74 and/or the position sensor 76 to the security controller 108. Many homes and businesses have a wireless local area network (such as WI-FI®) that allows the electronic componentry 70 in the hinge 24 to upload its sensory outputs 88 to the security controller 108. The electronic componentry 70, of course, may also utilize a private cellular network or even a broadband landline. Regardless, when the door 20 (illustrated as reference numeral 20 in FIGS. 1-3) swings in any direction, the electronic componentry 70 in the hinge 24 also moves, thus generating the velocity 46 and/or the angular position 78 associated with the swinging door 20. These sensory outputs 88 may be wirelessly uploaded to the security controller 108 (or any other destination) for analysis and potential intrusion or safety concern. Exemplary embodiments may thus infer an intrusion, an emergency evacuation, and even occupant movements.

Figure 8:
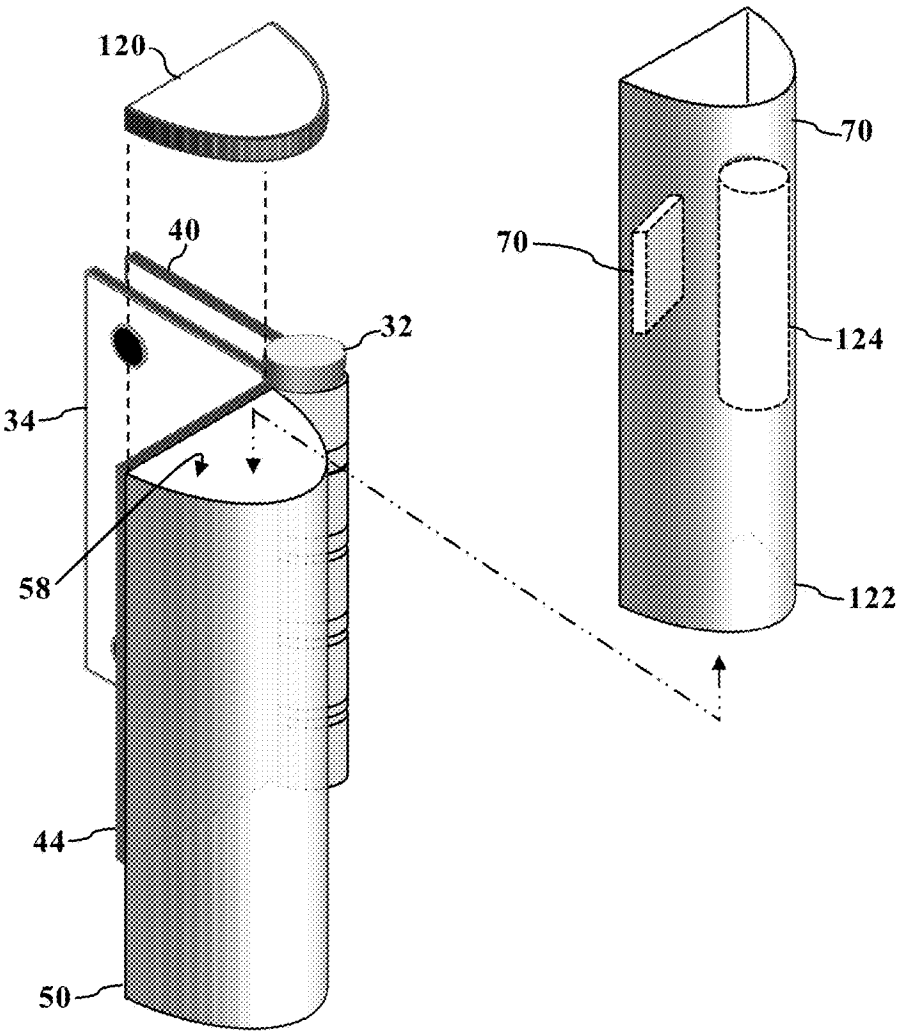

FIG. 8 illustrates modular electronics. Here the electronic componentry 70 may insert inside the hollow casing 50. That is, the hollow casing 50 may have removable access (such as a removable top 120). When the top 120 is removed, here the electronic componentry 70 may be inserted into, and removed from, the interior chamber 58. That is, the electronic componentry 70 may be a removable cartridge 122 for easy service and replacement. The removable cartridge 122, for example, may include a battery compartment for insertion or installation of a battery 124. The battery 124 provides electrical power for the electronic componentry 70. Should performance begin to wain (e.g., wireless range or reception), a user need only pop the top 120, remove the cartridge 122, and replace the battery 124. The cartridge 122 may thus be a self-contained electronics unit that is easily dropped into the chamber 58 formed by the hollow casing 50. Indeed, as technology advances and the electrical componentry 70 improves, the user need only purchase and replace an improved cartridge 122 with better performance.

The hollow casing 50 may thus protect the electronic componentry 70. As the door 20 swings about the pin 32 (as FIGS. 1-3 illustrate), exemplary embodiments may rotate with the third leaf 44. At some point, though, the door 20 may swing too far and strike or hit a wall (not shown for simplicity). If the hollow casing 50 were to impact the wall, the hollow casing 50 may crush and damage the internal electrical componentry 70. Exemplary embodiments may thus be constructed of a hard or rigid material (such as metal or plastic) that prevents crushing the hollow casing 50. The hollow casing 50 may thus not only protect the internal electrical componentry 70, but the hollow casing 50 may also function as a door stop to limit radial travel of the door 20.

Figure 9:
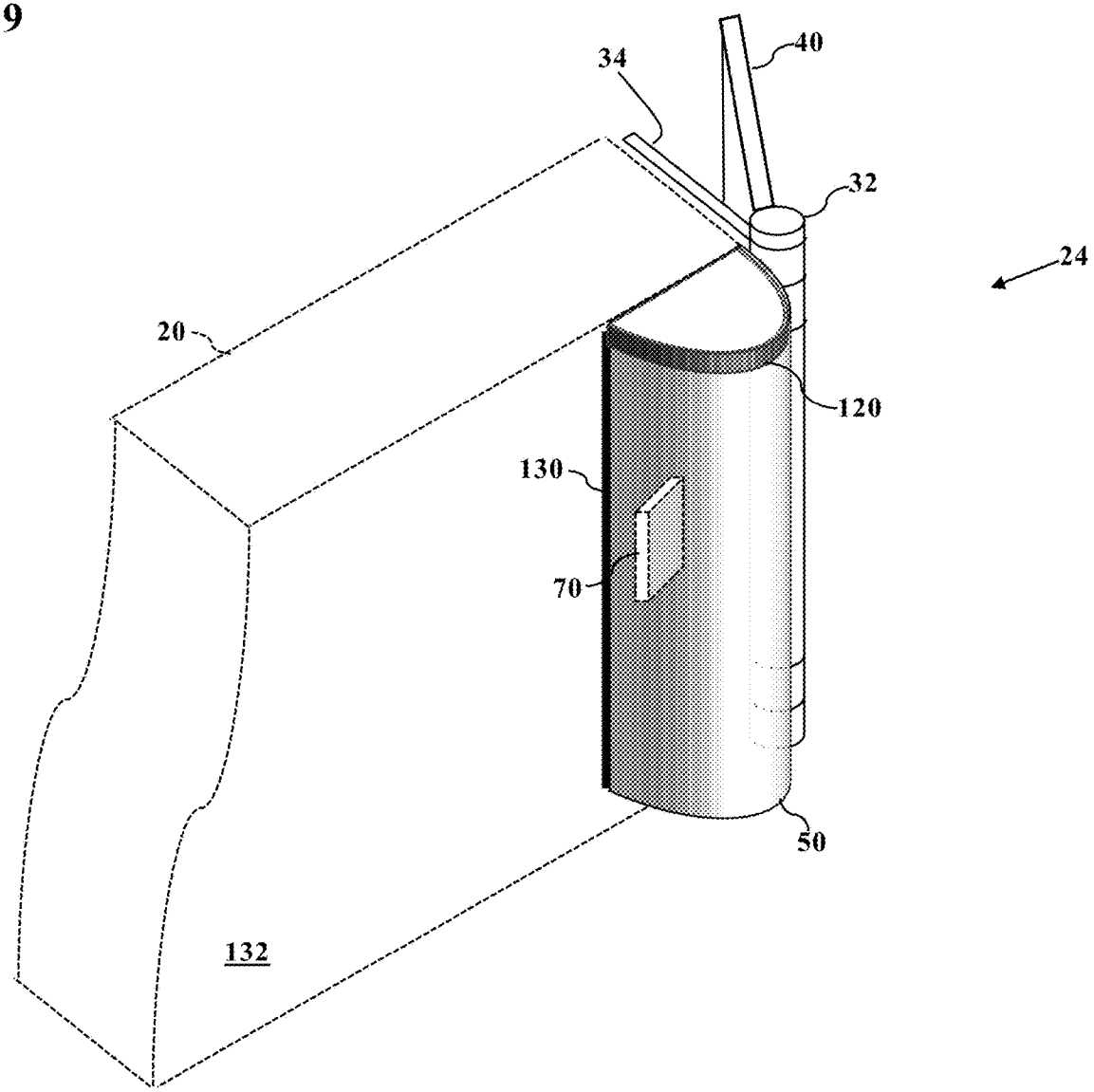

FIG. 9 illustrates an adhesive implementation. Here the hollow casing 50 may simply secure to the door 20. While the hollow casing 50 may be secured with threaded screws, FIG. 9 simply illustrates an adhesive backing 130. The hollow casing 50 may thus be glued or adhered to a panel side 132 of the door 20. Removal of the top 120 (as FIG. 8 best illustrates) allows access to the interior of the chamber 58 and the electronic componentry 70 inserted therein (as FIG. 8 best illustrates). Exemplary embodiments may thus stick to the door 20 without integration of the hinge 24.

Figure 10:
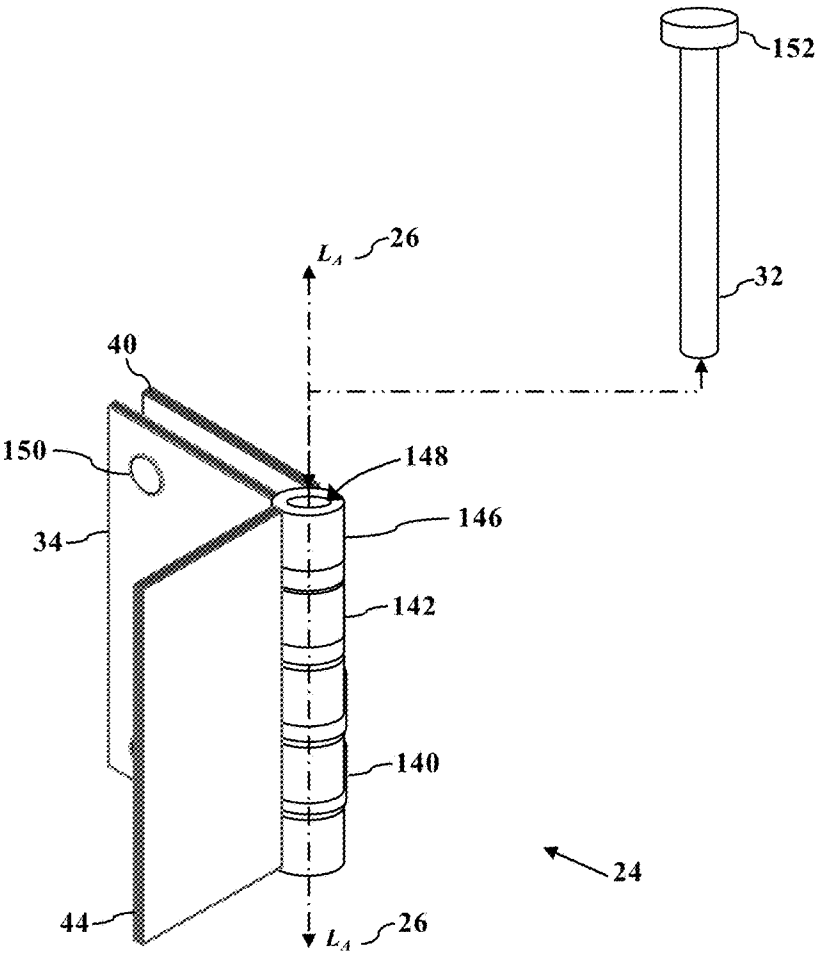
FIG. 10 is a more detailed, exploded illustration of a hinge, according to exemplary embodiments.

FIG. 10 is a more detailed, exploded illustration of the hinge 24, according to exemplary embodiments. The first leaf 34, the second leaf 40, and the third leaf 44 pivot or rotate about the pin 32. The first leaf 34 has one or more first knuckles 140, the second leaf 40 has one or more second knuckles 142, and the third leaf 44 has one or more third knuckles 146. The knuckles 142, 144, and 146 interleave and share a common bore 148 through which the pin 32 inserts. Each leaf 34, 40, and 44 may have one or more mounting holes 150 through which threaded screws may insert (not shown for simplicity). The leaves 34, 40, and 44 may thus all pivot about the longitudinal axis $L_A$-$L_A$ (illustrated as reference numeral 26) of the pin 32. The pin 32 may have a head 152 sized to prevent the pin 32 from sliding out of the common bore 148.

Figure 11:
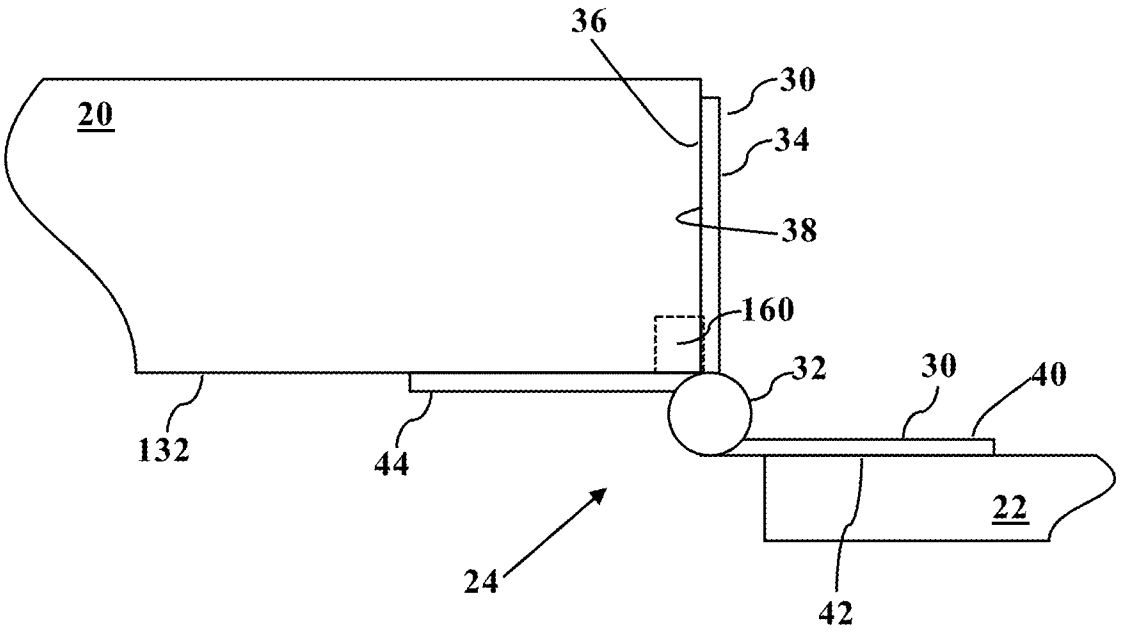
FIG. 11 illustrates orientational features, according to exemplary embodiments.

FIG. 11 illustrates orientational features, according to exemplary embodiments. The first leaf 34 secures to the door jamb 36 or edge 38 of the door 20. The second leaf 40 secures to the door frame 22 (such as the wall jamb 42). As the door 20 pivots or swings, the first leaf 34 rotates with respect to the stationary second leaf 40. The third leaf 44, though, also rotates with respect to the second leaf 40. That is, FIG. 11 illustrates the third leaf 44 secured to the panel side 132 (front or back) of the door 20. Because the door jamb 36 is perpendicular to the panel side 132, the first leaf 34 is perpendicular to the third leaf 44. The third leaf 44 may thus have a perpendicular orientation 160 to the first leaf 34. As the door 20 rotates about the pin 32, the first leaf 34 and the third leaf 44 may have a constant orientation of ninety degree (90°) with respect to each other.

Figure 12:
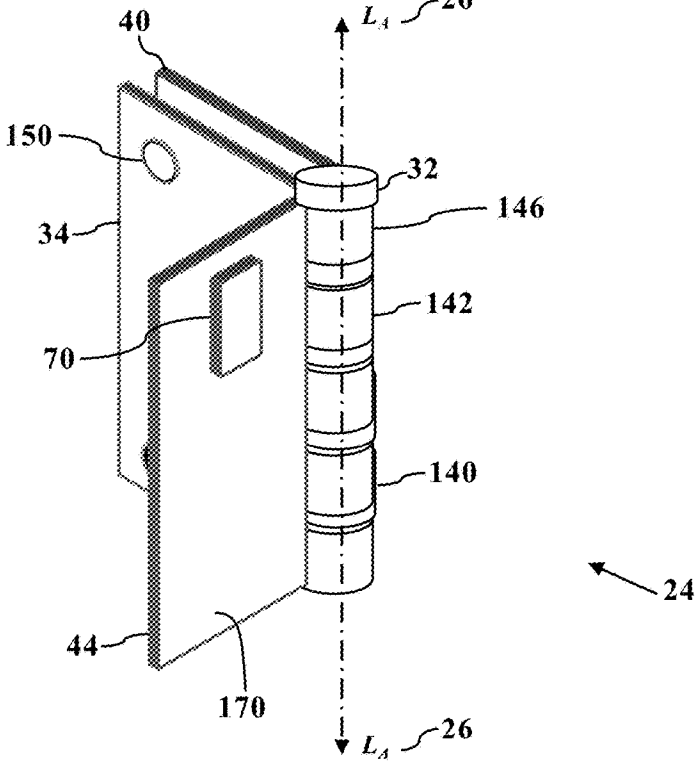
FIGS. 12-13 further illustrate sensory capabilities, according to exemplary embodiments.
Figure 13:
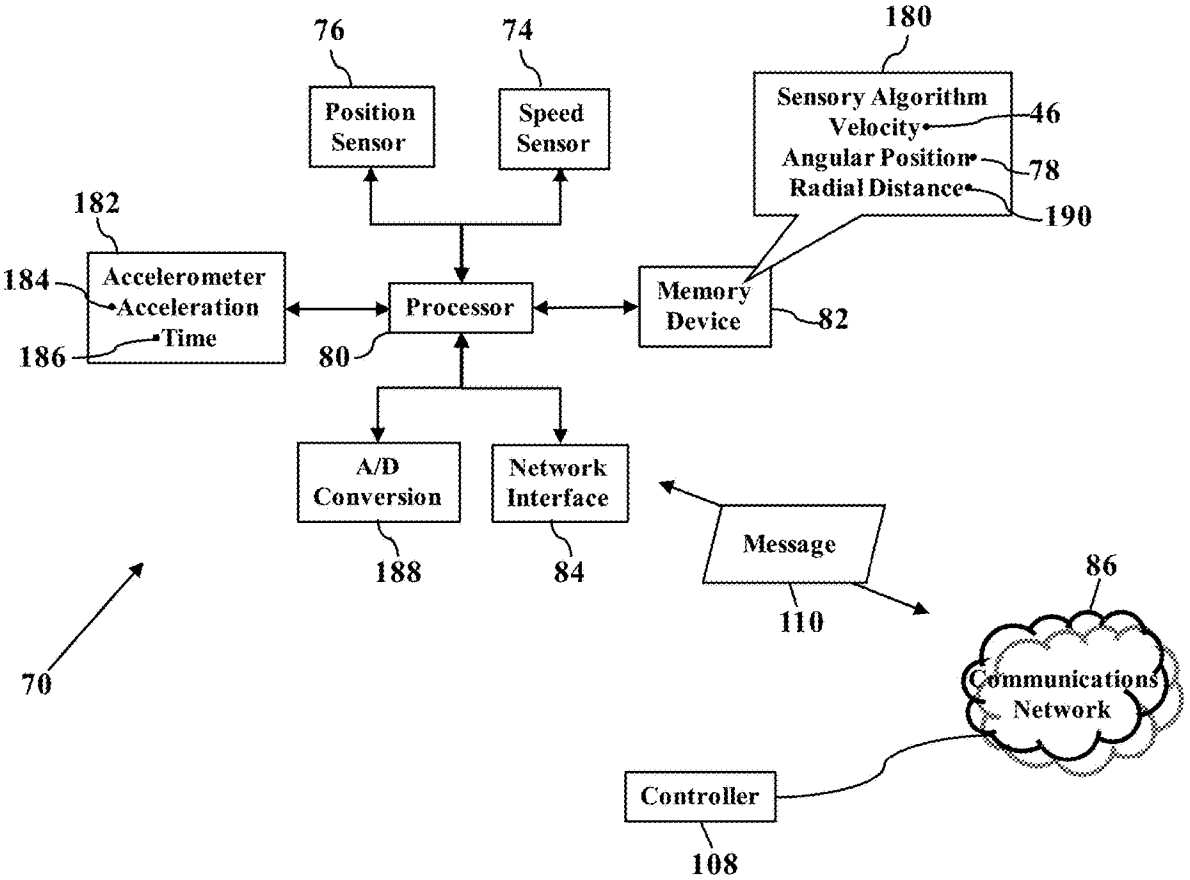

FIGS. 12-13 further illustrate the sensory capabilities, according to exemplary embodiments. Here the third leaf 44 may include the electronic componentry 70 that provides intelligent functionality. FIG. 12 illustrates the electronic componentry 70 packaged as a module or chip mounted or glued to an outer surface 170 of the third leaf 44. FIG. 13 illustrates a block diagram of the electronic componentry 70. As the door 20 (illustrated in FIGS. 1-3) swings about the pin 32, the third leaf 44 also rotates about the pin 32. The electronic componentry 70 may thus measure or infer information or data that describes the moving door 20. The processor 80 (e.g., "μP"), application specific integrated circuit (ASIC), or other component executes a sensory algorithm 180 stored in the memory device 82. The sensory algorithm 180 instructs the processor 90 to perform operations, such as describing or inferring the motion of the swinging door 20. The sensory algorithm 180, for example, may instruct the speed sensor 74 to call, invoke, or read an output value generated by an accelerometer 182. The accelerometer 182 measures or determines its angular acceleration value 184 associated with the pivoting third leaf 44 with respect to a time 186. The accelerometer 182 may itself have functionality that also outputs its velocity value and its position value, based on the angular acceleration value 184. That is, the accelerometer 182 may have a functional capability to determine accelerometer-based velocity and position as standard outputs. The sensory outputs of the accelerometer 182, in other words, may be related to the velocity 46 and angular position 78 of the pivoting third leaf 44 and, thus, to the door 20.

Exemplary embodiments may also infer speed and position. Once the accelerometer 182 determines its angular acceleration value 184, exemplary embodiments may calculate and/or infer the velocity 46 and angular position 78 of the pivoting third leaf 44 and to the door 20. If the angular acceleration value 184 is an analog value, then an analog-to-digital converter 188 may convert the analog value to a digital value. Regardless, when the processor 80 receives the angular acceleration value 184, the sensory algorithm 180 may cause the processor 80 to determine the velocity 46 associated with the swinging door 20. The processor 80, for example, may approximate the velocity 46 using $$v=R\omega,$$

where v represents the tangential velocity 46 of the pivoting third leaf 44, R is a predetermined radial distance 190 from an origin (e.g., the pin 32 at the axis $L_A$-$L_A$ illustrated as reference numeral 26 in FIG. 12), and ω is an angular velocity. The processor 80 may thus query the memory device 82 and retrieve the predetermined radial distance 190 to estimate the velocity 46. Moreover, the processor 80 may also call or invoke an integral operation of the acceleration value 184 over the time 186 using $$\int \alpha dt=\omega,$$

where α represents the angular acceleration value 184 of the pivoting third leaf 44 and ω is an angular velocity. In simple words, then, once the accelerometer 182 determines the angular acceleration value 194, exemplary embodiments may calculate, estimate, or infer the velocity 46 and the angular position 78 of the pivoting third leaf 44, which is related to the motion of the swinging door 20.

The electronic componentry 70 may also include the position sensor 76. Once the accelerometer 182 measures or determines its angular acceleration value 184, the angular position 78 of the pivoting third leaf 44 may also be determined. For example, a double integral of the angular acceleration value 184 (α) over the time 186 reveals or approximates the radial distance 190 or displacement of the swinging door 20.

As FIG. 13 also illustrates, exemplary embodiments may upload data to any network destination. The sensory algorithm 180 may cause the processor 80 to call or invoke the network interface 84 to wirelessly send the velocity 46 and the angular position 78 to any network destination. FIG. 13, for simplicity, illustrates the velocity 46 and the angular position 78 routing as the packetized message 110 via the communications network 86 to the Internet Protocol address associated with the security controller 108. The packetized message 110, though, may be routed via any private cellular network or even the public Internet to some other network address.

Information may be packetized. Any information sent or received via the communications network 86 may be formatted as packets of data according to a packet protocol (such as any of the Internet Protocols). The packets of data contain bits or bytes of data describing the contents, or payload, of a message. A header of each packet of data may contain routing information identifying an origination address and/or a destination address. The packets of data may thus be sent, received, and/or routed using network addresses associated with servers and devices.

Exemplary embodiments may be applied regardless of networking environment. Exemplary embodiments may be easily adapted to stationary or mobile devices having cellular, WI-FI®, near field, and/or BLUETOOTH® capability. Exemplary embodiments may be applied to any devices utilizing any portion of the electromagnetic spectrum and any signaling standard (such as the IEEE 802 family of standards, GSM/CDMA/TDMA or any cellular standard, and/or the ISM band). Exemplary embodiments, however, may be applied to any processor-controlled device operating in the radio-frequency domain and/or the Internet Protocol (IP) domain. Exemplary embodiments may be applied to any processor-controlled device utilizing a distributed computing network, such as the Internet (sometimes alternatively known as the "World Wide Web"), an intranet, a local-area network (LAN), and/or a wide-area network (WAN). Exemplary embodiments may be applied to any processor-controlled device utilizing power line technologies, in which signals are communicated via electrical wiring. Indeed, exemplary embodiments may be applied regardless of physical componentry, physical configuration, or communications standard(s).

Exemplary embodiments may utilize any processing component, configuration, or system. Any processor could be multiple processors, which could include distributed processors or parallel processors in a single machine or multiple machines. The processor can be used in supporting a virtual processing environment. The processor could include a state machine, application specific integrated circuit (ASIC), programmable gate array (PGA) including a Field PGA, or state machine. When any of the processors execute instructions to perform "operations", this could include the processor performing the operations directly and/or facilitating, directing, or cooperating with another device or component to perform the operations.

Figure 14:
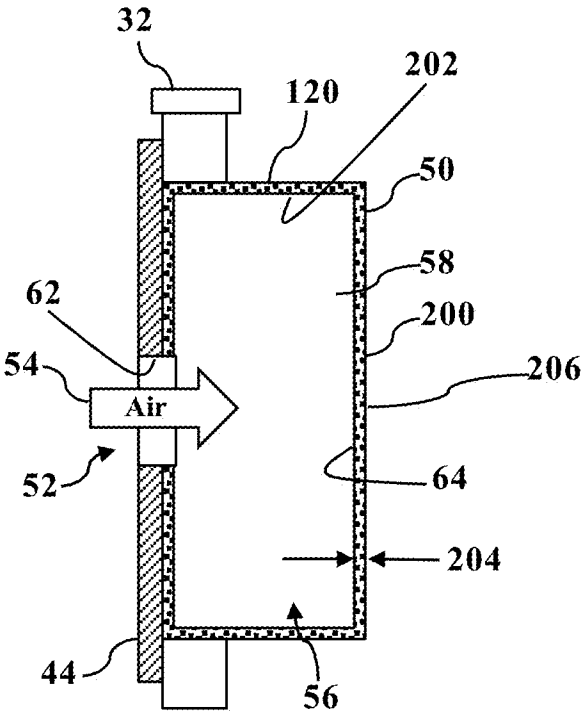
FIGS. 14-16 illustrate a hollow casing, according to exemplary embodiments.

FIG. 14 further illustrates the hollow casing 50, according to exemplary embodiments. Here again the hollow casing 50 is illustrated in the sectional view taken along line $L_4$-$L_4$ (illustrated as reference numeral 28) in FIG. 3. While the hollow casing 50 may have any exterior and interior shape, for simplicity FIG. 14 illustrates a generally rectangular cross-section 200 having an inner surface 202 defining the interior volume 64 of the chamber 58. The hollow casing 50 has a material thickness 204 between the inner surface 202 and an outer surface 206. The inner surface 202 thus defines the interior volume 64 of the pneumatic chamber 58. The hollow casing 50 may have any length, width, and depth to suit a design or performance criterion/criteria. Exemplary embodiments may include any features to facilitate removal and installation of the top 120 to the hollow casing 50 (such as lips or detents sized for a snap-fit relationship).

Figure 15:
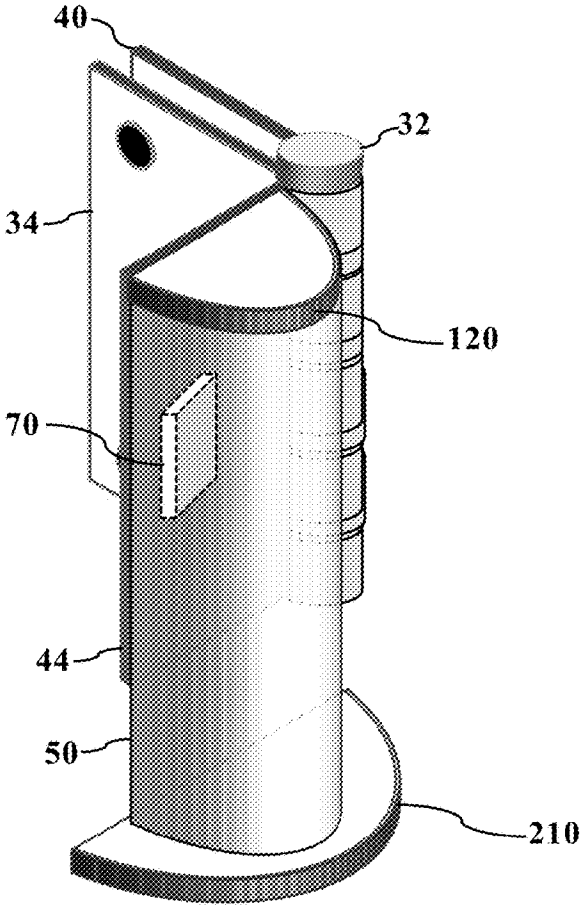
Figure 16:
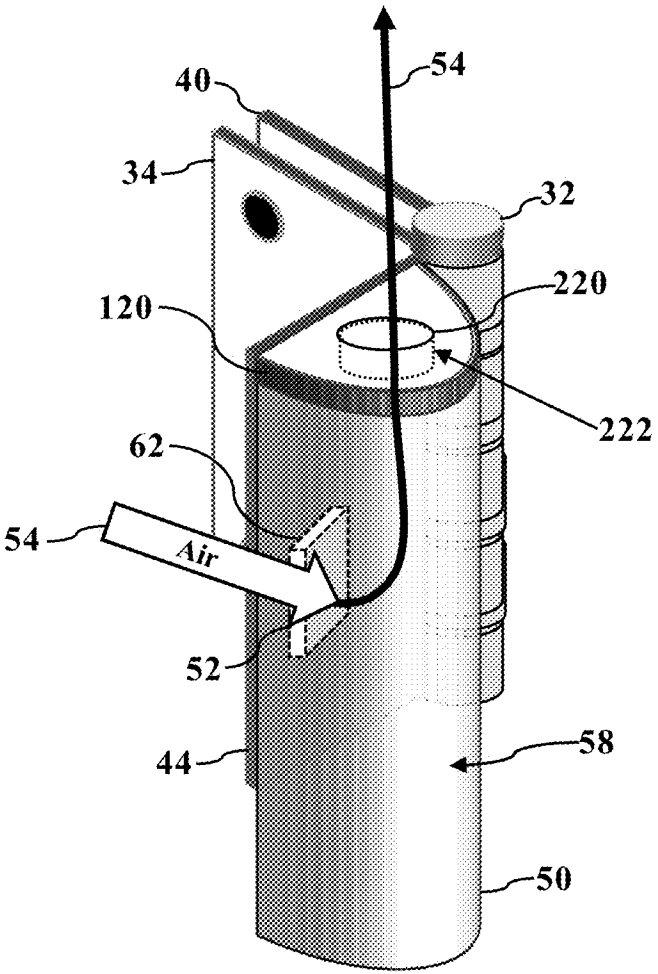

FIGS. 15-16 illustrates additional features of the hollow casing 50, according to exemplary embodiments. Here exemplary embodiments may include features for limiting a radial motion of the door 20 (illustrated in FIGS. 1-3). The removable top 120, for example, may be constructed of a material (such as metal or hard plastic) that prevents crushing the hollow casing 50. As the reader may envision, the door 20 may pivot or rotate about the pin 32 and eventually contact a wall (not shown for simplicity). If the hollow casing 50 were to impact the wall, the hollow casing 50 may crush and damage the internal electrical componentry 70. The removable top 120 may thus be designed to function as a door stop. If the removable top 120 is constructed of metal or hard plastic, the removable top 120 will limit or stop travel and protect the hollow casing 50 and the internal electrical componentry 70. Similarly, the hollow casing 50 my have a hard bottom component 210 that may additionally or alternatively function as a door stop. Moreover, as FIG. 15 further illustrates, exemplary embodiments may oversize a portion of the hollow casing 50 (such as the bottom component 210) to further ensure protection. FIG. 15 illustrates the bottom component 210 having a larger width and depth than the hollow casing 50 to further prevent crush and damage.

FIG. 16 illustrates another tunable feature. Here the hollow casing 50 may include an adjustable exhaust vent 220. The adjustable exhaust vent 220 extends through the material thickness 204 of the hollow casing 50 (as best is illustrated in FIG. 14). When the volume 54 of air enters through the vent 52, the exhaust vent 220 allows at least a portion of the volume 54 of air to escape, depending on a cross-sectional area 222. FIG. 16 illustrates the exhaust vent 220 having an enlarged cross-sectional area 222 for clarity. In actual practice, though, the cross-sectional area 222 may be smaller that the cross-sectional area 62 of the vent 52 to again restrict flow through the internal chamber 58. The exhaust vent 220 may further have features to adjust the cross-sectional area 62 (such as a pivoting or movable door, louvre, or shutter) for adjusting the cross-sectional area 62 to constrict and/or compress air pressure.

Figure 17:
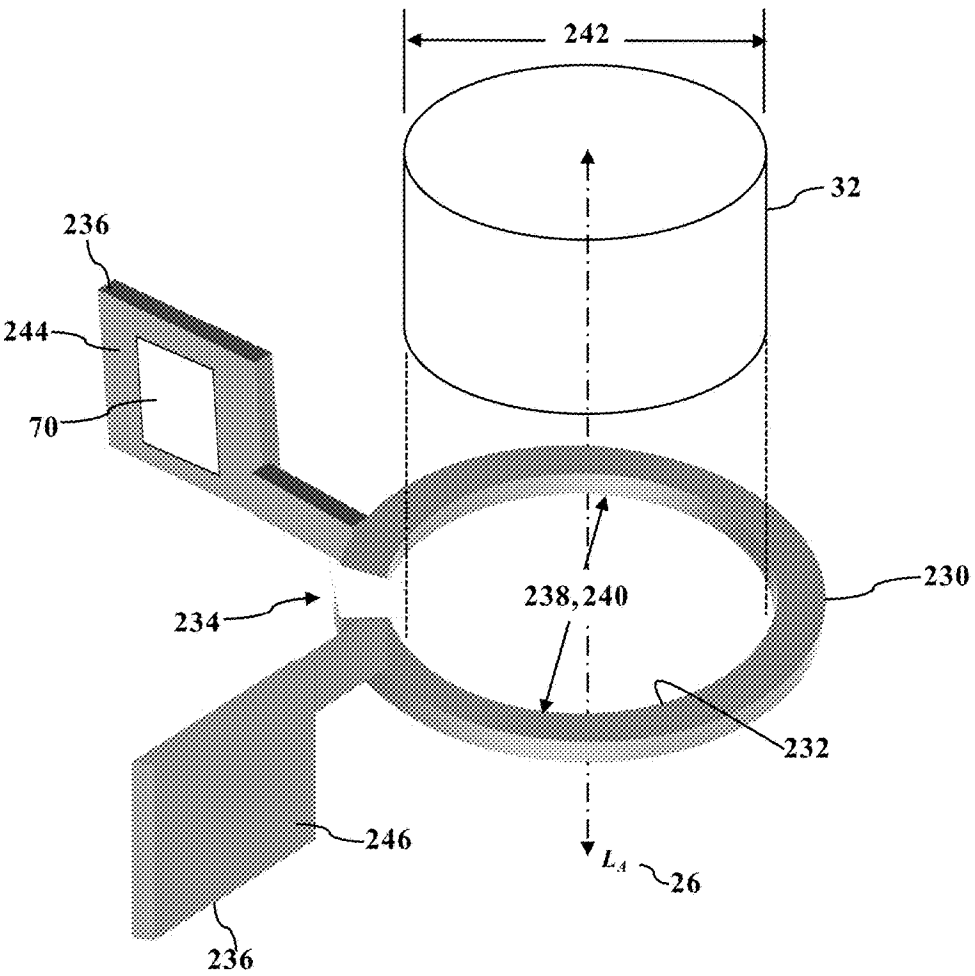
FIGS. 17-18 illustrate additional configurations, according to exemplary embodiments.
Figure 18:
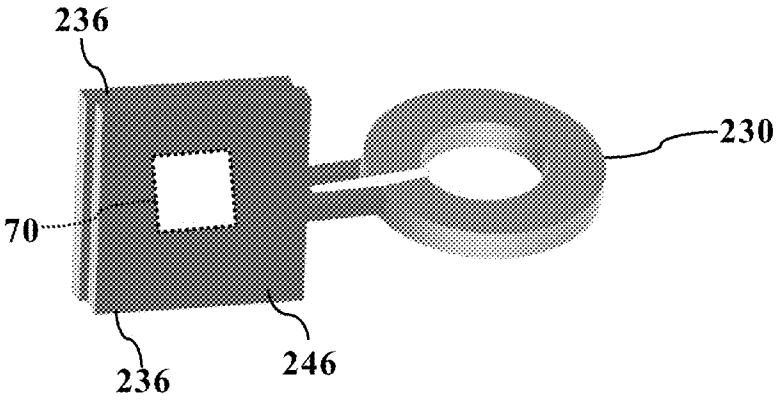

FIGS. 17-18 illustrate additional configurations, according to exemplary embodiments. Here the electronic componentry 70 may be secured or affixed to a circlip 230. FIG. 17 illustrates an enlarged view of the circlip 230 for clarity. While the circlip 230 may have any configuration, FIG. 17 illustrates the circlip 230 as a semi-circular ring 232 having an open end 234 formed by a pair 236 of fingers. The circlip 230 has a central bore 238 having an internal diameter 240 sized to an outer diameter 242 of the pin 32. The circlip 230 may be manufactured of resilient plastic or metal (such as spring steel) to flexibly bend the pair 236 of fingers and snap over a shaft of the pin 32. Alternatively, the pin 32 may be removed from the hinge 24 and slid through the central bore 238 and then reinserted into the hinge 24. The pair 236 of fingers may have respective fan faces 244 and 246 that remain nearly or substantially parallel with the longitudinal axis $L_A$ (illustrated as reference numeral 26) of the pin 32. Regardless, as the door 20 swings (as FIGS. 1-3 illustrate), at least one of the fan faces 244 and 246 may contact the door 20 (such as at the door jamb 38 or at the panel side 132 illustrated in FIG. 11). The electronic componentry 70 thus moves with the door 20 and generates the sensory outputs 88 (as this disclosure above explains). FIG. 18 thus illustrates the circlip 230 nearly fully compressed.

Figure 19:
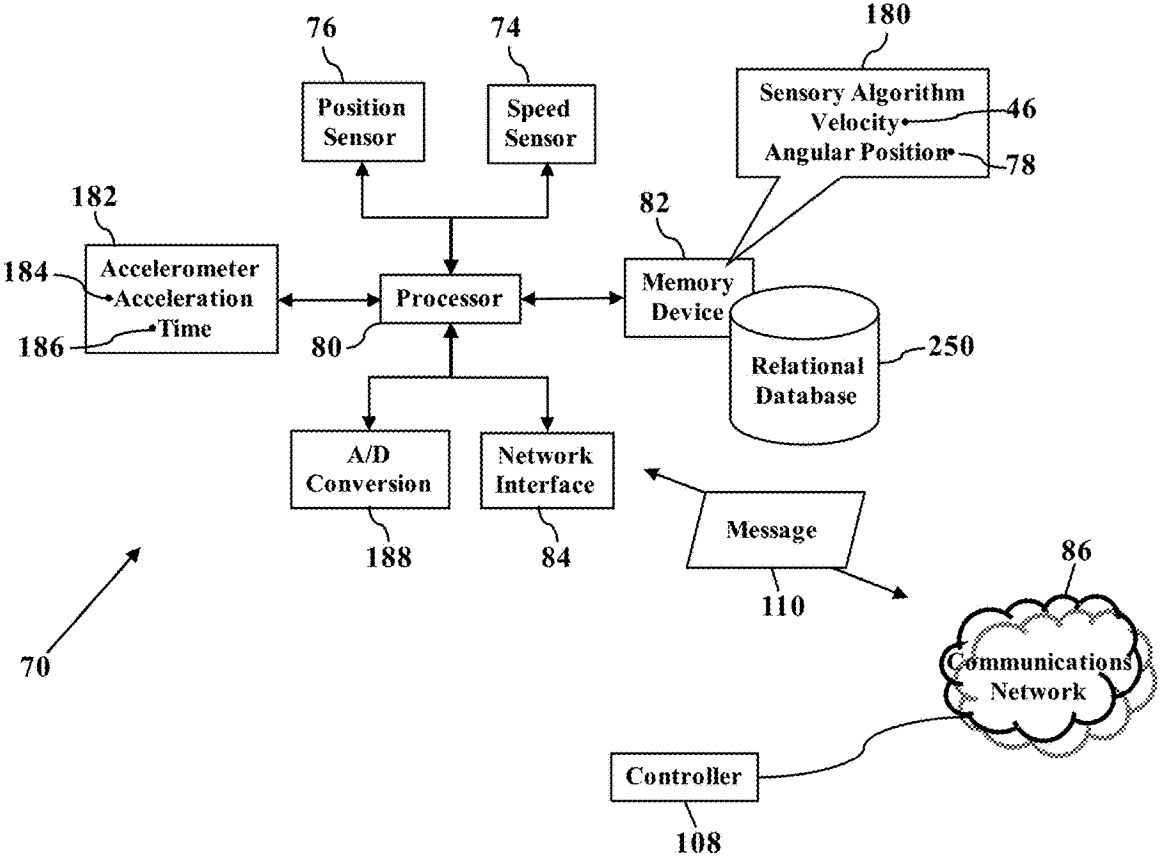
FIGS. 19-20 illustrate a relational database, according to exemplary embodiments.
Figure 20:
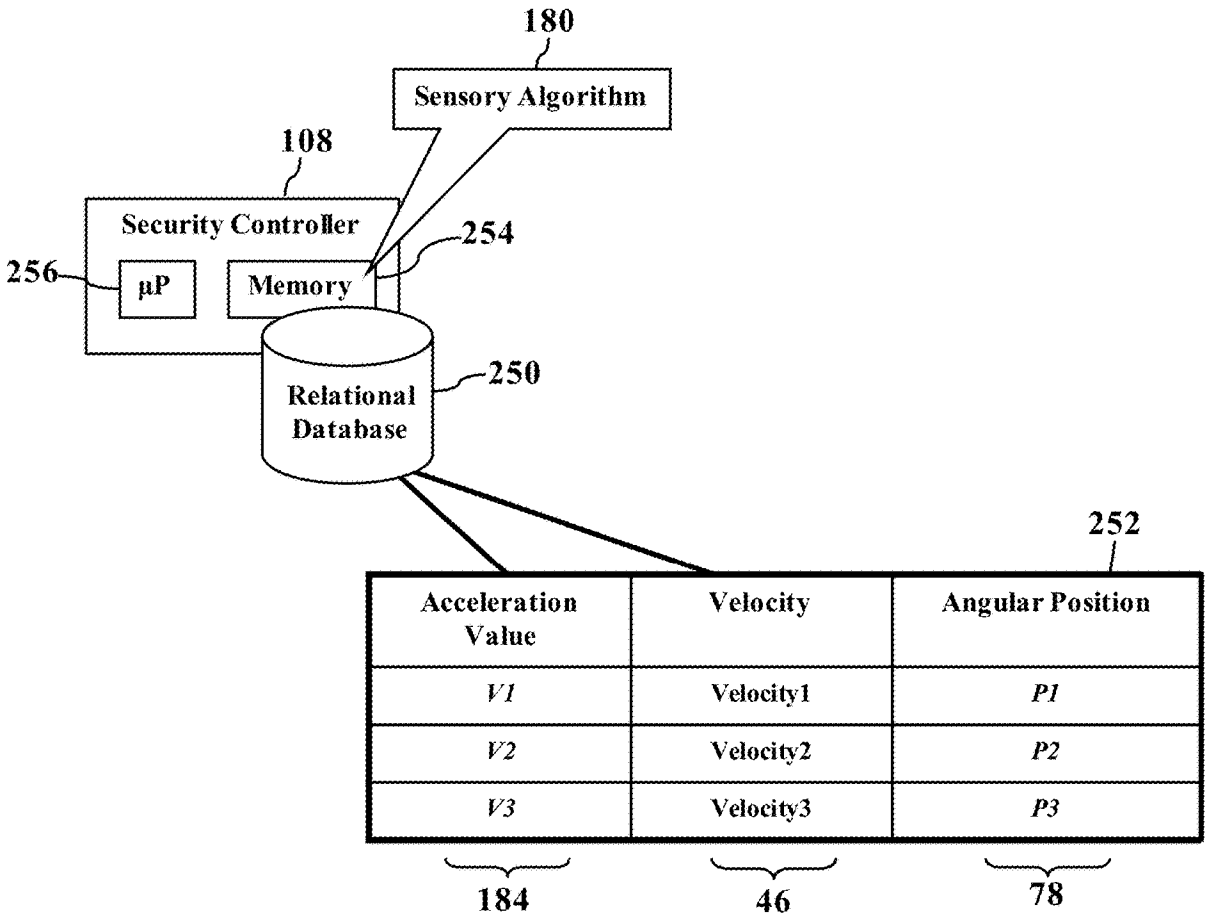
Figure 21:
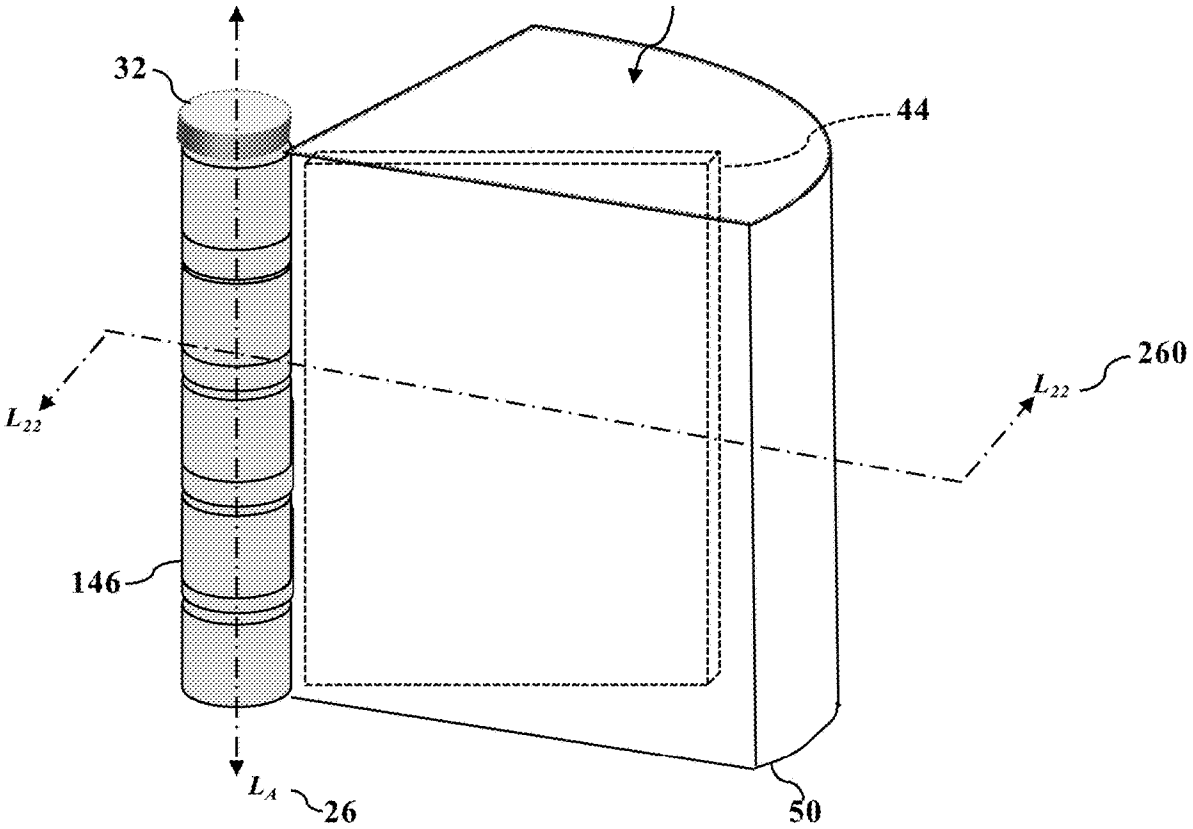
FIGS. 21-26 illustrate an encasement, according to exemplary embodiments.

FIGS. 19-20 illustrate a relational database 250, according to exemplary embodiments. Here exemplary embodiments may use the angular acceleration value 184 to infer the velocity 46 and the angular position 78 of the swinging door 20. Once the accelerometer 182 determines its angular acceleration value 194, the processor 80 may query the electronic relational database 250 for the angular acceleration value 194. FIG. 19 illustrates the electronic relational database 250 as being stored in the local memory device 82, but the electronic relational database 250 may be remotely stored and maintained at any network location (such as a memory device in the security controller 108).

FIG. 20 further illustrates the electronic relational database 250. Here the electronic relational database 250 is illustrated as being locally stored in the security controller 108 (as the above paragraph suggested). Once the accelerometer 182 determines its angular acceleration value 194, the electronic componentry 70 may send the angular acceleration value 194 to the security controller 108 (as explained with reference to FIGS. 7 and 13). So, whether the electronic relational database 250 is locally stored in the electronic componentry 70 of the hinge 24 or in the security controller 108, exemplary embodiments may query the electronic relational database 250. FIG. 20 illustrates the electronic relational database 250 as a table 252 that electronically maps, relates, or associates different angular acceleration values 194 to different velocities 46 and to different angular positions 78. A memory device 254 in the security controller 108 may thus store at least a portion of the sensory algorithm 180, and the sensory algorithm 180 has code or instructions that instruct a processor 256 to query for the angular acceleration value 194. If a matching entry is found, exemplary embodiments may retrieve the corresponding velocity 46 and/or the angular position 78. The electronic relational database 250 may thus have entries that have been pre-calculated or pre-determined for the different angular acceleration values 194 and, thus, the swinging door 20. The electronic relational database 250 thus allows exemplary embodiments to avoid complex calculations (such as the integrals above explained), and the accelerometer 182 may have basic functional features for a lower cost.

Exemplary embodiments may thus determine cumulative positions and distances. Any time the door 20 swings, exemplary embodiments may maintain a log of the movements. Exemplary embodiments, for example, may store each angular acceleration value 194, the velocity 46, and/or the angular position 78 in the memory device 82 with a date/time stamp. As the door 20 is moved throughout the day, exemplary embodiments may track the angular acceleration value 194, the velocity 46, and/or the angular position 78 at different times. Some movements may be one direction (such as an opening motion), while other movements may be in the opposite direction (such as a closing motion). Some movements, in other words, may have a positive value (e.g., opening), which other motions may have a negative value (e.g., closing). As exemplary embodiments log the door's motions, exemplary embodiments may maintain a sum of the angular acceleration value 194, the velocity 46, and/or the angular position 78. For example, positive and negative summations of the different angular positions 78 allows exemplary embodiments to nearly always infer or determine a current angular position 78 at any time. Exemplary embodiments may thus store predetermined ratios and movements of the third leaf 44 to infer the movements of the door 20. The sensory algorithm 180 may thus infer the motion of the door 20 using a starting position, speed, and/or duration of travel associated with the third leaf 44.

FIGS. 21-26 illustrate the third leaf 44 encased in the hollowing casing 50, according to exemplary embodiments. Here the third leaf 44 may pivot or rotate within the hollow casing 50. The third leaf 44 may still rotate about the pin 32 defining the longitudinal axis $L_A$ 26 (via the third knuckles 146, as this disclosure explains), yet the third leaf 44 moves within the interior 56 of the hollow casing 50.

Figure 22:
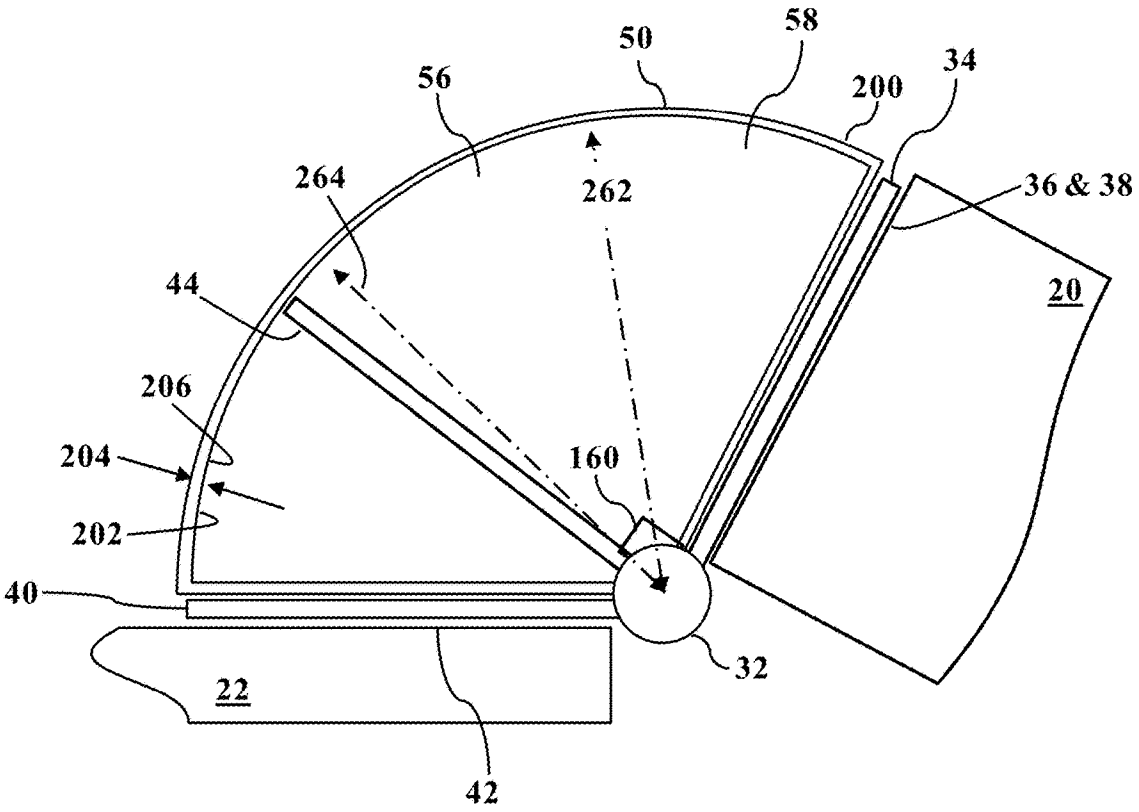
Figure 23:
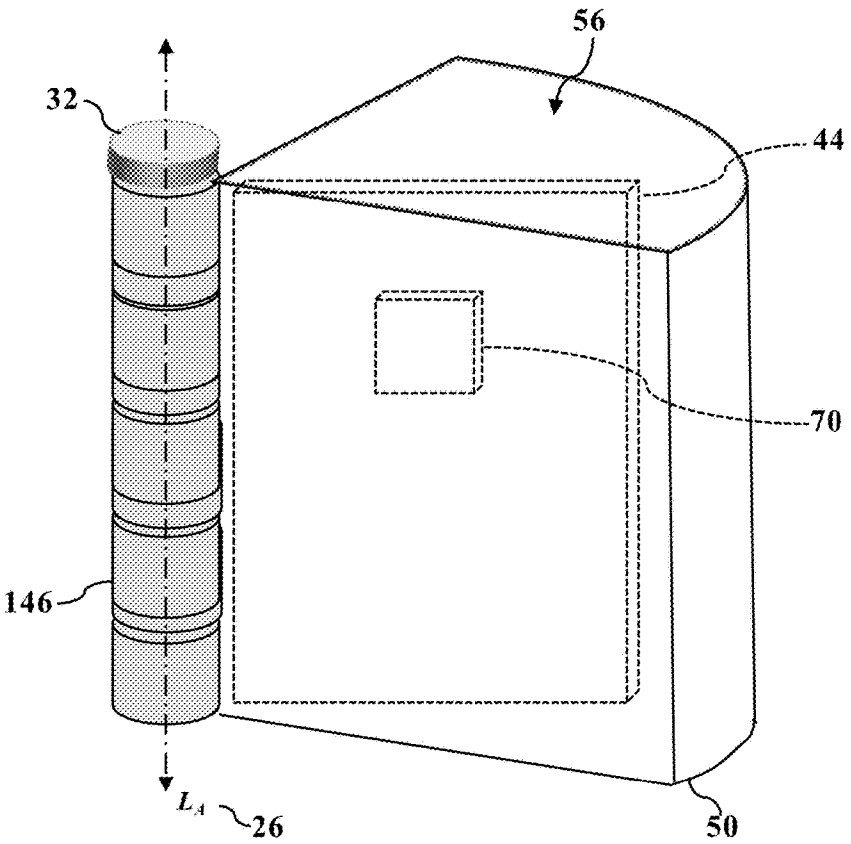

FIG. 22 is a sectional view. Here the sectional view is taken along line $L_{23}$-$L_{23}$ (illustrated as reference numeral 260) in FIG. 22. While the hollow casing 50 may have any exterior and interior shape, FIG. 23 illustrates a generally rounded wedged cross-section 200 having the inner surface 202 defining the interior 56 of the chamber 58, and the material thickness 204 separates the inner surface 202 from the outer surface 206. Because the third leaf 44 may pivot or rotate within the interior 56 of the chamber 58, the hollow casing 50 may be sized to the third leaf 44. That is, the hollow casing 50 may have an interior cross-sectional radius 262 that is at least equal to, and preferably greater than, a radial length 264 of the third leaf 44 (perhaps as measured from the longitudinal axis $L_A$-$L_A$ 26 defined by the pin 32).

The third leaf 44 moves with the door 20. The first leaf 34 secures to the door jamb 36 of the door 20. The second leaf 40 secures to the door frame 22 (such as the wall jamb 42). As the door 20 pivots or swings, the first leaf 34 and the third leaf 44 both rotate with respect to the stationary second leaf 40. The third leaf 44, though, also rotates with respect to the second leaf 40. While the third leaf 44 may have any orientation, FIG. 22 illustrates the third leaf 44 having the perpendicular orientation 160 (e.g., ninety degree (90°) angle) to the edge 38 of the door 20. As the door 20 rotates about the pin 32, the first leaf 34 and the third leaf 44 may thus have a constant orientation of ninety degrees (90°) with respect to each other. Because the third leaf 44 may be contained within the hollow casing 50, the third leaf 44 may move within a sector defined by the inner surface 202 of the interior 56. As the door 20 swings, the hollow casing 50 may not move or rotate about the pin 32, thus remaining in a stationary position. However, the third leaf 44 rotates about the pin 32 but inside the hollow casing 50.

FIG. 23 illustrates the electronic componentry 70. The electronic componentry 70 is again illustrated as the package or chip mounted or glued either surface of the third leaf 44. FIG. 13 illustrates a block diagram of the electronic componentry 70. As the third leaf 44 moves with the door 20 (as illustrated in FIGS. 1-3 and 22), the electronic componentry 70 measures or infers information or data that describes the moving door 20 (as this disclosure above explains). The movement of the third leaf 44 within the hollow casing 50, in other words, may be interpreted with respect to the swinging door 20.

Figure 24:
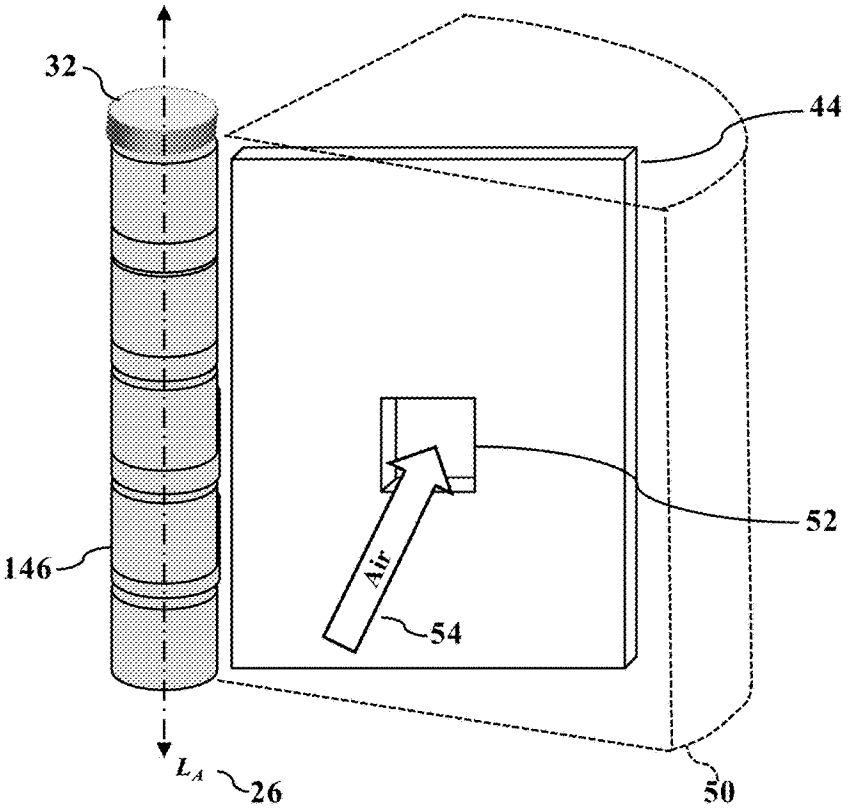
Figure 25:
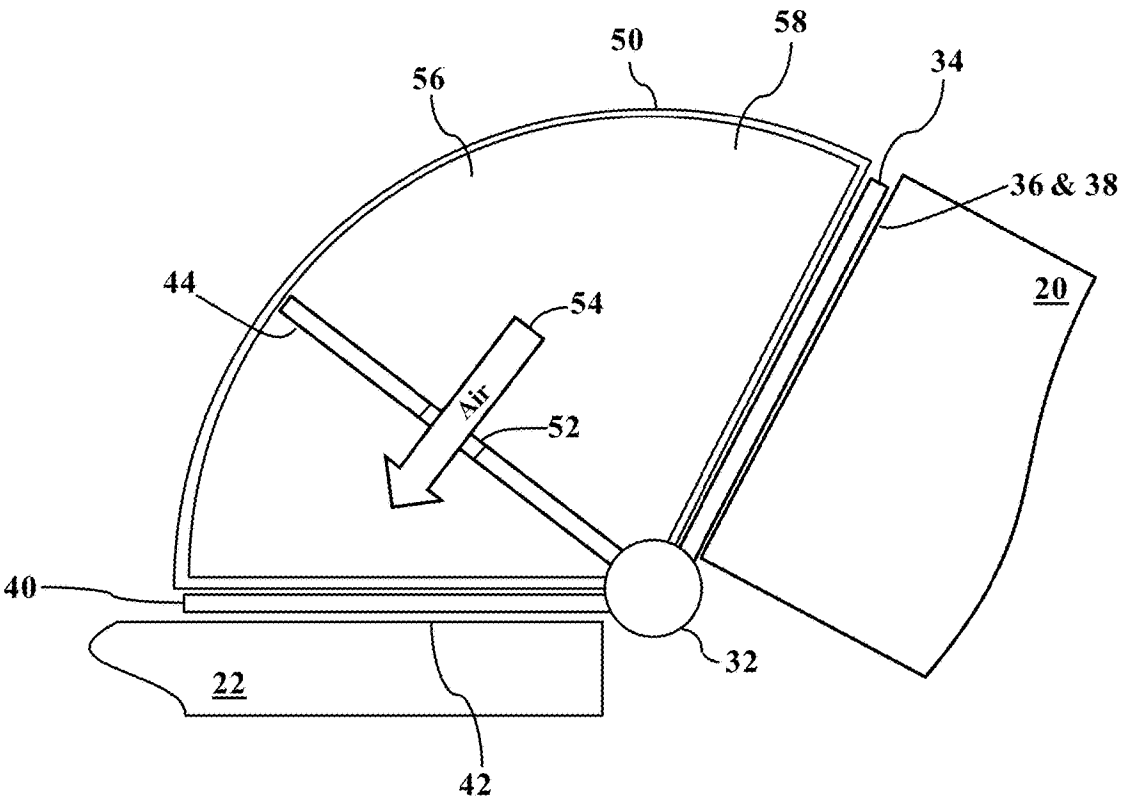
Figure 26:
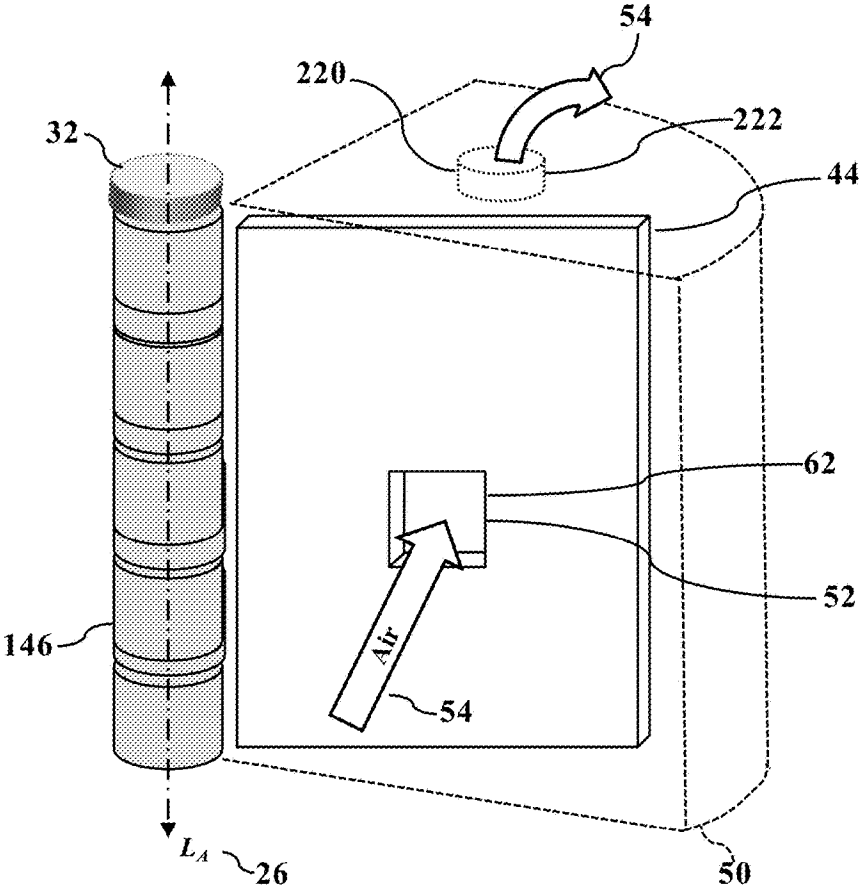

FIGS. 24-26 illustrate velocity control. As the third leaf 44 pivots within the hollow casing, exemplary embodiments may include means for damping the velocity of rotation (illustrated as reference numeral 46). For example, the third leaf 44 may include the one-way vent 52. As the third leaf 44 swings with the door 20 (as FIG. 25 best illustrates), the volume 54 of air within the interior 56 attempts to flow or pass through the vent 52. The vent 52, though, may only substantially allow flow in a single direction within the interior 56 of the hollow casing 50. Consider that the one-way vent 52 may freely flow the volume 54 of air as the door 20 opens, but the one-way vent 52 may dampen rotation as the door 20 closes. That is, when the door 20 is closed, air flow through the one-way vent 52 may be restricted (as FIG. 25 illustrates), thus slowing or dampening movement of the door 20. When the hollow casing 50 is substantially air-tight, the pneumatic air chamber 58 acts as a physical or flow/pressure restriction to the volume 54 of air flowing through the vent 52. Exemplary embodiments thus cushion or damp the motion of the third leaf 44 and, thus, the door 20.

FIG. 26 illustrates the exhaust vent 220. The adjustable exhaust vent 220 extends through the material thickness 204 of the hollow casing 50 (as best is illustrated in FIG. 22). When the volume 54 of air enters through the vent 52, the exhaust vent 220 allows at least a portion of the volume 54 of air to escape, depending on the cross-sectional area 222. FIG. 26 illustrates the exhaust vent 220 having an enlarged cross-sectional area 222 for clarity. In actual practice, though, the cross-sectional area 222 may be smaller that the cross-sectional area 62 of the vent 52 to again restrict flow through the internal chamber 58. The exhaust vent 220 may further have features to adjust the cross-sectional area 62 (such as a pivoting or movable door, louver, or shutter) for adjusting the cross-sectional area 62 to constrict and/or compress air pressure.

Exemplary embodiments are tunable. The cross-sectional area 62 of the vent 52 may be sized to control the velocity 46 of the swinging door 20. The cross-sectional area 222 of the exhaust vent 220 may also be sized to control the velocity 46 of the swinging door 20. The interior volume 64 of the chamber 58 may also be sized to control the velocity 46 of the door 20. The vent 52 and the chamber 58 may thus be sized, shaped, and tuned to limit the volume 54 of air passing through the vent 52 and thus control the motion of the door 20.

Exemplary embodiments may also include travel control. The hollow casing 50 may further have features for limiting a radial motion of the door 20. The hollow casing 50, for example, may have the removable top 120 (as illustrated with reference to FIG. 15). The removable top 120 may be constructed of a material (such as metal or hard plastic) that prevents crushing the hollow casing 50. The removable top 120 may thus be designed to function as a door stop that limits travel. Similarly, the hollow casing 50 my have the hard bottom component 210 (again illustrated with reference to FIG. 15) that may additionally or alternatively function as a door stop. The sizes of the removable top 120 and/or the bottom component 210 may be chosen or varied (e.g., width and depth) to limit travel. Here, then, the removable top 120 and/or the bottom component 210 may not move and remain stationary to stop the door 20 from opening too wide.

Figure 27:
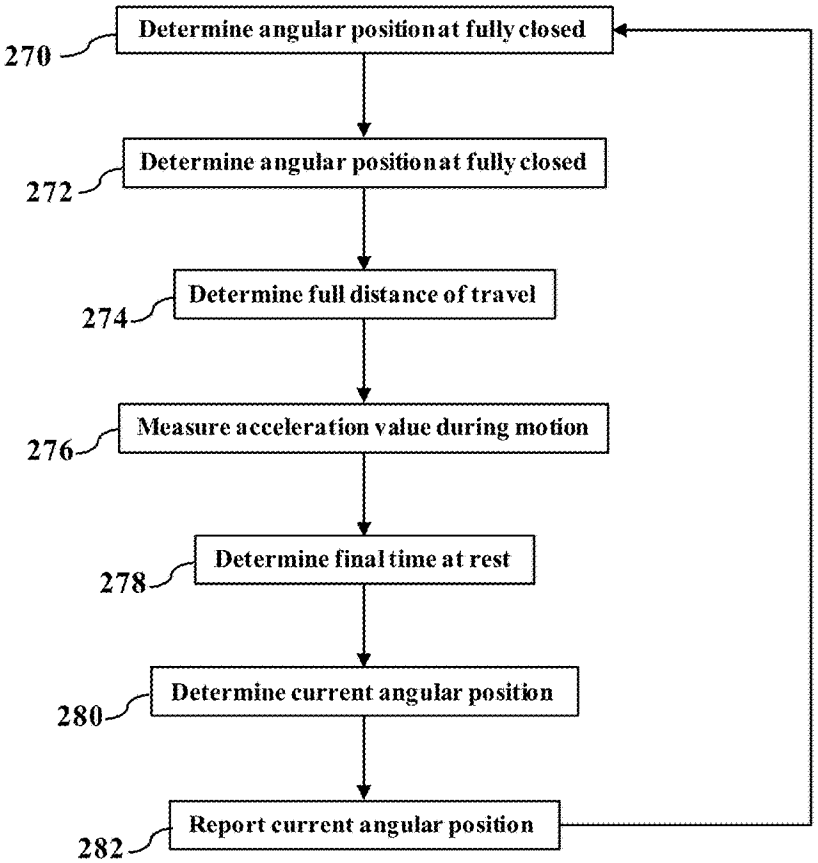
FIG. 27 is a flowchart illustrating a method or algorithm for inferring motion of a swinging door, according to exemplary embodiments.

FIG. 27 is a flowchart illustrating a method or algorithm for inferring motion of the swinging door 20, according to exemplary embodiments. Exemplary embodiments may determine the angular position 78 associated with the door 20 at fully closed (Block 270) and at fully open (Block 272). Exemplary embodiments may thus determine a full distance of travel based on the angular positions 78 at fully closed to fully open (Block 274). When motion is detected (e.g., the acceleration value 184 is non-zero), exemplary embodiments measure the acceleration value 184 with time (Block 276). The electronic componentry 70, for example, may initialize a timer that starts incrementing at an initial value (zero). When the acceleration value 184 returns to zero, motion has stopped and a final time (Block 278) is determined. The final time may thus be a final value of the timer. A current angular position 78 may thus be determined (Block 280) based on a motion duration (e.g., the final value of the timer), the output of the speed sensor 74, the output of the position sensor 76, and/or the acceleration value 184. The current angular position 78 may additionally or alternatively be determined by querying the relational database 250 (as explained with reference to FIGS. 19-20). Exemplary embodiments may then report the current angular position 78 to a network destination (such as via the electronic message 110 explained with reference to FIG. 7) (Block 282).

Figure 28:
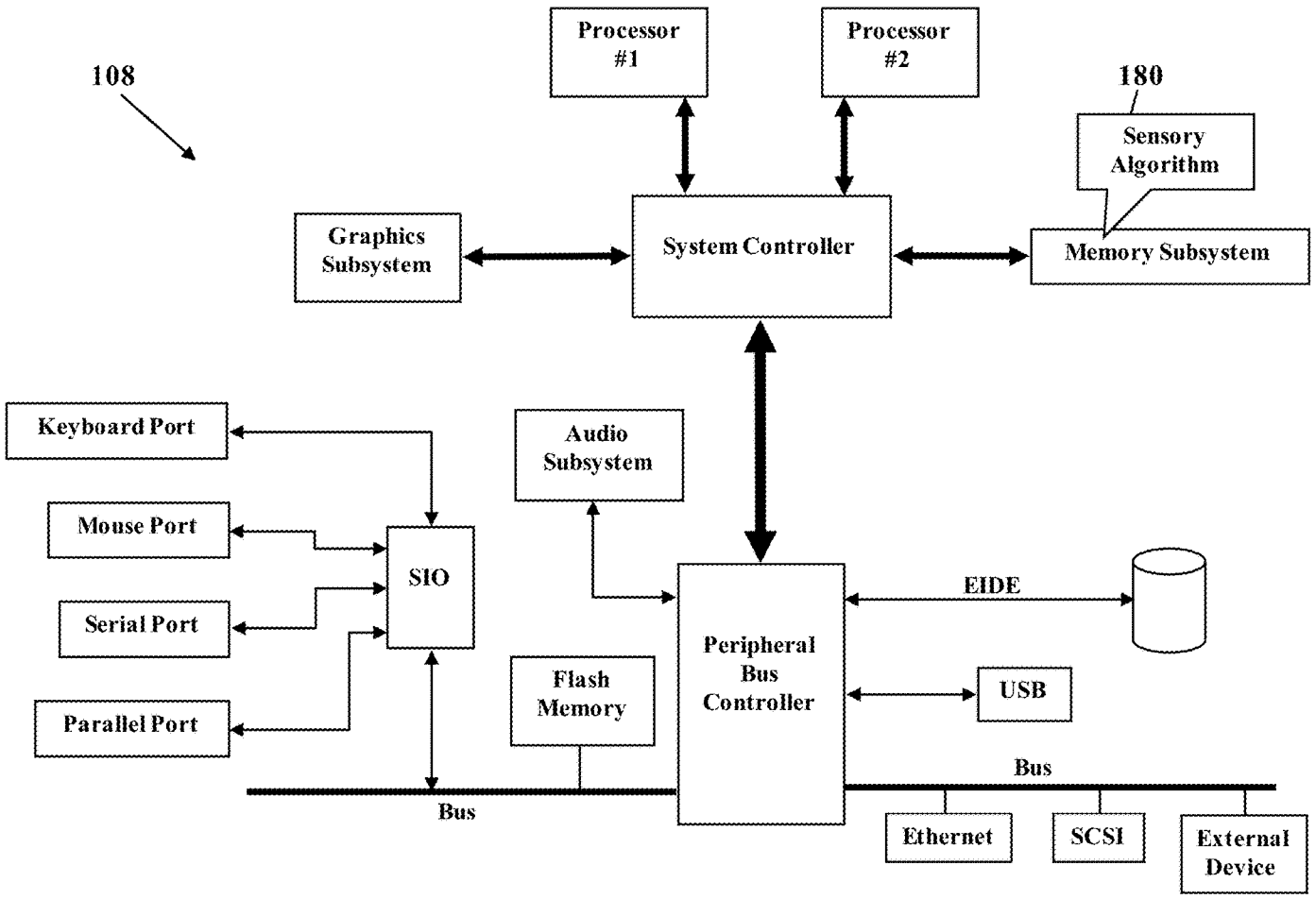
FIG. 28 depicts still more operating environments for additional aspects of the exemplary embodiments.

FIG. 28 is a schematic illustrating still more exemplary embodiments. FIG. 28 is a more detailed diagram illustrating the security controller 108. As earlier paragraphs explained, exemplary embodiments may partially or entirely operate in any mobile or stationary processor-controlled device. FIG. 28, then, illustrates the sensory algorithm 180 stored in a memory subsystem of the security controller 108. One or more processors communicate with the memory subsystem and execute either, some, or all applications.

Exemplary embodiments may be physically embodied on or in a computer-readable memory device or other storage medium. This computer-readable medium, for example, may include CD-ROM, DVD, tape, cassette, floppy disk, optical disk, memory card, memory drive, and large-capacity disks. This computer-readable medium, or media, could be distributed to end-subscribers, licensees, and assignees. A computer program product comprises processor-executable instructions for inferring motion of the swinging door 20, as the above paragraphs explained.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. A hinge for a door, comprising:

a first leaf having a first knuckle, the first knuckle rotatable about a pin inserted through a common bore;

a second leaf having a second knuckle, the second knuckle rotatable about the pin inserted through the common bore, the second knuckle interleaved with the first knuckle; and a third leaf encased within a hollow casing, the third leaf having a third knuckle rotatable about the pin inserted through the common bore, the third knuckle interleaved with at least one of the first knuckle and the second knuckle;

wherein the first leaf and the second leaf secure to the door to allow the door to rotate about the pin.

2. The hinge of claim 1, further comprising a vent in the third leaf of the hinge, the vent restricting a flow of air therethrough to dampen a movement of the third knuckle rotating about the pin.

3. The hinge of claim 2, wherein the hollow casing is in a fluid communication with the vent in the third leaf, the hollow casing forming a pneumatic chamber that restricts the flow of the air through the vent to dampen the movement of the third knuckle pivoting about the pin.

4. The hinge of claim 1, further comprising a position sensor mounted to the third leaf, the position sensor generating an output for determining an angular position associated with the door.

5. The hinge of claim 1, further comprising a velocity sensor mounted to the third leaf, the velocity sensor generating an output for determining a velocity associated with the movement of the third knuckle rotating about the pin.

6. The hinge of claim 1, wherein the third leaf rotates within the hollow casing.

7. The hinge of claim 1, wherein the third leaf rotates within an interior of the hollow casing.

8. The hinge of claim 1, wherein the hollow casing remains stationary as the third leaf rotates about the pin.

9. A hinge for a door, comprising:

a first leaf having a first knuckle, the first knuckle rotatable about a pin, the pin inserted through a common bore;

a second leaf having a second knuckle, the second knuckle rotatable about the pin inserted through the common bore, the second knuckle interleaved with the first knuckle;

a third leaf encased within a hollow casing, the third leaf having a third knuckle, the third knuckle rotatable about the pin inserted through the common bore, the third knuckle interleaved with at least one of the first knuckle and the second knuckle; and electronic componentry secured to the third leaf, the electronic componentry determining an acceleration value as the third leaf rotates about the pin within the hollow casing;

wherein the first leaf and the second leaf secure to the door to allow the door to rotate about the pin, and the electronic componentry secured to the third leaf infers a motion of the door based on the acceleration value.

10. The hinge of claim 9, further comprising a vent in the third leaf of the hinge, the vent restricting a flow of air therethrough as the third leaf rotates within the hollow casing to dampen a velocity of the door rotating about the pin.

11. The hinge of claim 10, wherein the hollow casing is in a fluid communication with the vent in the third leaf, the hollow casing forming a pneumatic chamber that restricts the flow of the air through the vent to dampen the velocity of the third leaf pivoting about the pin.

12. The hinge of claim 9, wherein the electronic componentry determines an angular position associated with the third leaf based on the acceleration value.

13. The hinge of claim 9, wherein the electronic componentry determines a velocity associated with the third leaf based on the acceleration value.

14. The hinge of claim 9, wherein the electronic componentry comprises a network interface to a communications network.

15. The hinge of claim 9, wherein the first leaf and the third leaf have a perpendicular orientation.

16. The hinge of claim 9, wherein the second leaf remains perpendicularly oriented to the third leaf during rotation about the pin.

17. A hinge for a door, comprising:

a first leaf having a first knuckle, the first knuckle rotatable about a pin;

a second leaf having a second knuckle, the second knuckle rotatable about the pin, the second knuckle interleaved about a common bore with the first knuckle;

a third leaf encased within a hollow casing, the third leaf having a third knuckle, the third knuckle rotatable about the pin inserted through the common bore, the third knuckle interleaved with at least one of the first knuckle and the second knuckle about the common bore; and electronic componentry secured to the third leaf, the electronic componentry determining an acceleration value as the third leaf rotates about the pin within the hollow casing;

wherein the first leaf and the second leaf secure to the door to allow the door to rotate about the pin, and the electronic componentry secured to the third leaf infers a motion of the third leaf based on the acceleration value.

18. The hinge of claim 17, further comprising a vent in the third leaf of the hinge, the vent restricting a flow of air therethrough to dampen a velocity of the third leaf rotating about the pin within the hollow casing.

19. The hinge of claim 18, wherein the hollow casing is in a fluid communication with the vent in the third leaf, the hollow casing forming a pneumatic chamber that restricts the flow of the air through the vent to dampen the velocity of the third leaf pivoting about the pin.

20. The hinge of claim 17, wherein the electronic componentry determines an angular position associated with the third leaf based on the acceleration value.

* * * * *